US006101918A

United States Patent [19]

Akins

[11] Patent Number: 6,101,918

[45] Date of Patent: Aug. 15, 2000

[54] METHOD AND APPARATUS FOR ACCELERATING THE CYCLIC FIRING RATE OF A SEMI-AUTOMATIC FIREARM

[76] Inventor: William Akins, 18807 Tracer Dr., Lutz, Fla. 33549

[21] Appl. No.: 09/076,548

[22] Filed: May 12, 1998

[51] Int. Cl.[7] ..... F41A 19/00

[52] U.S. Cl. ..... 89/129.01; 89/136

[58] Field of Search ..... 89/129.01, 129.02, 89/136, 140, 151

[56] References Cited

U.S. PATENT DOCUMENTS

| | | | |
|---|---|---|---|
| 981,210 | 1/1911 | Menteyne et al. | 89/140 |
| 1,587,009 | 6/1926 | Kewish | 89/140 |
| 2,361,985 | 11/1944 | Birkigt | 89/152 |
| 2,465,487 | 3/1949 | Sampson et al. | 89/140 |
| 4,553,468 | 11/1985 | Castellano et al. | 89/140 |
| 4,787,288 | 11/1988 | Miller | 89/27.3 |
| 5,074,190 | 12/1991 | Troncoso | 89/136 |
| 5,852,891 | 12/1998 | Onishi et al. | 42/69.01 |

*Primary Examiner*—Charles T. Jordan
*Assistant Examiner*—Jeffrey Howell
*Attorney, Agent, or Firm*—Renner, Kenner, Greive, Bobak, Taylor & Weber

[57] ABSTRACT

An accelerating assembly effectively to increase the cyclic rate at which the trigger of a semi-automatic firearm can be actuated to discharge the weapon. The firearm has a supporting device, a receiver housing supported from the supporting device, a trigger and trigger mechanism secured to the receiver housing. The accelerating mechanism incorporates structure that permits the receiver and the trigger to translate rearwardly a predetermined distance with respect to the supporting device in response to the recoil imparted by the discharge of the semi-automatic firearm. A biasing arrangement continuously urges the receiver, and trigger, to translate forwardly with respect to the supporting device substantially that same predetermined distance. A locating stop is mounted on the supporting device. The locating stop is disposed to be engaged by the shooter's finger after the trigger has been actuated to fire the semi-automatic weapon. That engagement of the shooter's trigger finger with the locating stop effectively immobilizing the shooter's trigger finger with respect to the supporting device until the shooter releases the trigger. The method of the present invention operates by depressing the trigger with a shooter's trigger finger in order to discharge the firearm. The shooter's finger is then immobilized in the position it has assumed to discharge the firearm. The trigger is translated away from the immobilized trigger finger to effect a total disengagement therebetween. Sequentially thereafter the trigger is biased into engagement with the immobilized trigger finger to effect successive discharges of the firearm.

19 Claims, 16 Drawing Sheets

METHOD AND APPARATUS FOR ACCELERATING THE CYCLIC FIRING RATE OF A SEMI-AUTOMATIC FIREARM

TECHNICAL FIELD

The present invention relates generally to firearms. More particularly, the present invention relates to methods and structural arrangements by which to accelerate the cyclic firing rate of a semi-automatic firearm. Specifically, the present invention relates to a method and apparatus which accelerates the cyclic firing rate of a semi-automatic firearm by moving the trigger successively into and out of contact with the shooter's trigger finger while maintaining the butt of the stock in firm, uninterrupted contact with the shooter's shoulder. Accordingly, the trigger finger disengages the trigger for each successive firing, insuring the preservation of the semi-automatic action and its mechanism.

BACKGROUND OF THE INVENTION

Although today's media inaccurately, and irresponsibly, designate semi-automatic firearms as being "automatic" weapons, one must not lose sight of the fact that there is a significant distinction between a semi-automatic and an automatic (perhaps, more accurately, a "fully automatic") firearm.

Semi-automatic firearms do—in response to the discharge of the firearm—eject a spent cartridge casing and sequentially feed a loaded cartridge into the chamber. However, a semi-automatic firearm will not fire the cartridge so loaded until the trigger has been released and then sequentially re-depressed. That is, even if the shooter maintains the trigger depressed in the firing position after a cartridge has been fired, the successively chambered cartridge will not be discharged without the aforesaid release and re-depression of the trigger. Such a firearm may be an "auto-loading" firearm—i.e., a semi-automatic firearm—but it is not an automatic firearm.

Generally speaking, an automatic firearm, will, to the contrary, continue to fire all available rounds in the magazine so long as the trigger remains depressed. By way of an exception, it should be noted that there are automatic firearms which will selectively discharge bursts of only a predetermined number of rounds in response to depressing the trigger only one time, but they are still automatic firearms.

It must be understood that it is forbidden by the National Firearms Act to possess automatic firearms within the United States, or the District of Columbia, without special authorization, and full details covering compliance with that Act are available from the Department of the Treasury, the Bureau of Alcohol, Tobacco and Firearms, commonly designated as the B.A.T.F.

When one understands the operational distinction between automatic and semi-automatic firearms, it can be readily understood that the cyclic firing rate for a semi-automatic firearm is normally limited by the reaction time within which the shooter can squeeze the trigger to fire a round, release the trigger as the firearm recoils in response to discharge of the first round, and then re-squeeze the trigger to discharge the next successive round. Although the cyclic time will differ from shooter to shooter, even the most practiced shooter will be unable to discharge more than two or three rounds at a rate less than about one round per second.

One prior known attempt to enhance the cyclic firing rate of a seni-automatic firearm is sold under the trademark HELL-FIRE (or, more recently, HELL-STORM) and is often designated as the "Hell Fire System" or "HFS".

The HFS constitutes a spring biased paddle that engages the rear of the trigger and continually urges it forwardly. To operate the HFS, one balances the firearm by supporting it with one hand—viz., by grasping the fore-end of the stock with the hand other than the hand having the trigger finger—and then placing the trigger finger across the trigger without depressing the trigger. The trigger is depressed by pushing the fore-end of the stock, with the supporting hand, toward the target and allowing that movement to bring the trigger into contact with the trigger finger in order to depress the trigger and discharge the firearm.

The discharge recoil moves the entire weapon—including the trigger—rearwardly, and thereafter the biasing action of the paddle against the rear of the trigger moves the trigger forwardly a sufficient distance to reset the trigger so that continued forward pressure applied to the fore-end of the stock by the hand that is supporting the firearm will translate the firearm forwardly, and thereby bring the trigger into engagement against the trigger finger with a sufficient force to re-depress the trigger. The trigger finger is not to be moved.

The aforedescribed operation of the HFS is difficult to master and does not lend itself to accuracy inasmuch as the stock is never permitted to rest firmly against the shooter's shoulder—nor is the hand containing the shooter's trigger finger permitted to grasp the firearm firmly, as required to achieve even a modicum of accuracy.

SUMMARY OF THE INVENTION

It is, therefore, a primary object of the present invention to provide an improved method and apparatus by which the cyclic firing rate of a semi-automatic firearm can be selectively accelerated.

It is another object of the present invention to provide an improved method and apparatus, as above, that will increase the cyclic firing rate without changing the semi-automatic status of the firearm.

It is a further object of the present invention to provide an improved method and apparatus, as above, wherein the recoil imparted to the firearm by discharging cartridges frees the trigger from the shooter's trigger finger with each successive discharge to permit the fire control mechanism of the semi-automatic firearm to be activated without the need for moving the trigger finger, or for that matter, any part of the shooter's body with respect to the structure—such as the stock—by which the firearm is supported.

It is still another object of the present invention to provide a method and apparatus, as above, whereby the trigger finger is selectively immobilized after a first round is discharged, and the trigger assembly is thereupon sequentially translated to move the trigger sequentially away from and against the trigger finger so long as it remains voluntarily immobilized.

It is a still further object of the present invention to provide an improved method and apparatus, as above, which permits the shooter to rest the butt of the stock firmly against the shooter's shoulder.

It is an even further object of the present invention to provide an improved method and apparatus, as above, which permits the shooter firmly to grasp the stock with both hands At least one or more of the foregoing objects of the invention, as well as the advantages thereof over existing and prior art forms, which will be apparent in view of the following detailed specification, are accomplished by means hereinafter described and claimed.

In general, an apparatus embodying the concepts of the present invention effectively increases the cyclic rate at which the trigger of a semi-automatic firearm can be actuated to discharge the firearm, and as such the new and novel apparatus may properly be designated as an "accelerating mechanism". The firearm has a supporting device, a receiver housing supported from the supporting device, with a trigger and trigger mechanism, secured to the receiver housing. The accelerating mechanism incorporates structure that permits the conjoined receiver housing, trigger and associated trigger mechanism to translate rearwardly a predetermined distance with respect to the supporting device in response to the recoil imparted by the discharge of the semi-automatic firearm. A biasing arrangement continuously urges the conjoined receiver housing, trigger and trigger mechanism to translate forwardly with respect to the supporting device substantially that same predetermined distance.

A locating stop is mounted on the supporting device. The locating stop is disposed to be engaged by the shooter's trigger finger in that position where the trigger finger has depressed the trigger sufficiently to fire the semi-automatic weapon. Engagement of the shooter's trigger finger with the locating stop effectively immobilizes the shooter's trigger finger with respect to the supporting device until the shooter releases the trigger finger from the stop.

A method embodying the concept of the present invention operates by depressing the trigger with a shooter's trigger finger in order to discharge the firearm. The shooter's finger is immobilized in the position it assumed to discharge the firearm. At least the trigger, and associated trigger mechanism, is translated rearwardly away from the immobilized trigger finger by virtue of the recoil resulting from discharging the firearm to effect a total disengagement between the trigger and the trigger finger—thereby allowing the trigger mechanism to "reset" for firing the next successive cartridge. Sequentially thereafter the trigger is biased forwardly into engagement with the immobilized trigger finger to effect a successive discharge of the firearm. This operation will repeat until the shooter's trigger finger is removed from the stop or the last cartridge loaded in the magazine has been fired.

To acquaint persons skilled in the arts most closely related to the present invention, two preferred and two alternative embodiments of an accelerating assembly that illustrate four best modes now contemplated for putting the invention into practice are described herein by, and with reference to, the annexed drawings that form a part of the specification. The exemplary accelerating assemblies are described in detail without attempting to show all of the various forms and modifications in which the invention might be embodied. As such, the embodiments shown and described herein are illustrative, and as will become apparent to those skilled in these arts, can be modified in numerous ways within the scope and spirit of the invention—the invention being measured by the appended claims and not by the details of the specification.

DESCRIPTION OF AN EXEMPLARY EMBODIMENT

Figure 1:
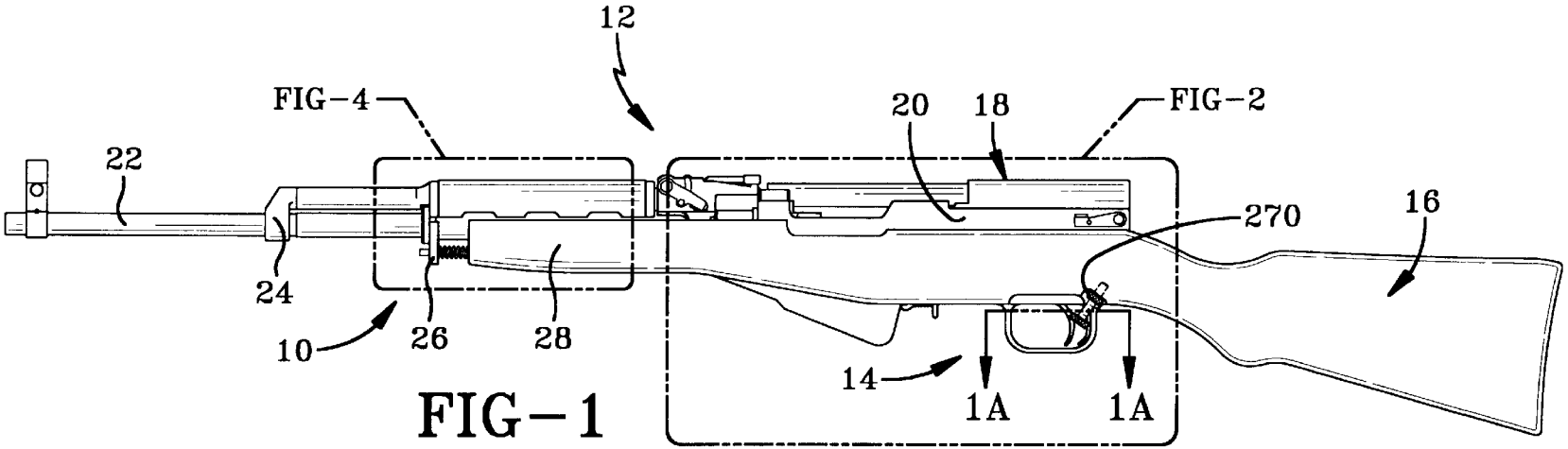
FIG. 1 is a side elevation, partly in longitudinal section, of a seni-automatic SKS Carbine, the stock thereof having been structurally modified to permit selective acceleration of the firing cycle of such a carbine without altering the semi-automatic status of the firearm.

The present invention is directed to a method and apparatus by which to accelerate the cyclic firing rate of a semi-automatic firearm, and as such, the various structural components of one example of such an accelerating assembly are designated generally, and collectively, by the numeral 10 in FIGS. 1 through 6 of the attached drawings. The aforesaid accelerating assembly 10 is depicted in conjunction with an SKS Carbine, the side elevation of which is best seen in FIG. 1 wherein it is designated generally by the numeral 12. The present invention also provides an accelerating assembly adapted for usage with a MAK-90 firearm, it being understood that the two firearms have been selected merely to demonstrate the manner in which various accelerating assemblies can be employed with various semi-automatic firearms, in this instance rifles.

General Background of the SKS Carbine and a MAK-90

The SKS Carbine 12 was selected for several reasons. First, the SKS is a foreign military weapon that has been in use since the latter days of World War II and has seen action in Korea, Vietnam and sundry other minor conflicts around the world. The SKS Carbine remains a secondary substitute standard weapon for some small European and Asiatic countries. The design of the SKS Carbine allows it to be manufactured relatively inexpensively. Even so, the functionality of the SKS Carbine has been quite well thought out—particularly the sundry safety features incorporated in its relatively complex, but reliable, fire control mechanism. The many favorable attributes of the SKS Carbine make it one of the more popular of the foreign military weapons currently owned by U.S. gun collectors and enthusiasts.

The SKS Carbine was designed by Sergi Gavrilovich Simonova, and the Carbine is designated as the Samozaryadni (self-loading) Karabin (carbine) Simonova (the designer's name)—the initialism for which is SKS. The SKS Carbine is light in weight and is designed for the also light weight 7.62×39 mm cartridge. That cartridge was selected by the designer because its size and weight permitted a soldier to carry an increased amount of ammunition with less resultant recoil. However, the SKS Carbine lacks a crucial feature that is desired for a military weapon—viz.: it is incapable of affording selective fire (the ability to operate in either a semi-automatic mode or a fully automatic mode.

At about the same time that the SKS Carbine was beginning to come off the production lines, another Russian arms designer—Mikhail Timofeyevich Kalishnikov—was working to develop a military firearm that would also utilize the 7.62×39 mm cartridge. That rifle is the AK-47. In short order the AK-47 became the most produced weapon in the world, but it must be recognized that many of the basic design features which contributed to the success of the SKS Carbine were included in the AK-47. Moreover, the 7.62×39 mm ammunition—used in both the SKS and the AK-47—is one of the least expensive and most plentiful of all military rifle ammunition available in the United States.

The complex fire control arrangement utilized in the SKS was, however, not carried forward into the MAK-90, and because of the rather distinct fire control mechanisms employed in these two firearms they have been selected as being representative of how the present accelerating assembly can be readily adapted to a wide variety of firearms.

Although the AK-47 is, selectively, fully automatic and employs removable magazines, versions which are semi-automatic were imported into the U.S. in fairly large numbers. Certain "appearance" features of the seni-automatic versions originally imported were, however, deemed unacceptable and were, therefore, included within the importation ban established on Nov. 18, 1990, by Title 18 of the United States Code, Section 922(r). Those features—viz.: a bayonet, or even a bayonet mounting lug, the threaded end portion of the barrel, a flash suppressor and a distinct [i.e.: separate from the stock] pistol grip that extends downwardly free of the main portion of the stock—were eliminated on the "sporter" version of the AK-47, one such sporter version being designated as the MAK-90.

Introduction to the Fire Control Mechanism of an SKS Carbine

The SKS fire control mechanism is relatively complex and contains many safeguards which preclude the gun from discharging unless: 1) the bolt is properly positioned "in battery"; and, 2) the movable components which interact with the bolt are themselves properly positioned—all of which will be hereinafter more fully explained. In order, therefore, to provide the most comprehensive understanding as to the operation of the accelerating assembly 10, it is appropriate to understand the assembly and operation of the SKS Carbine 12—and particularly the trigger assembly 14 with which the accelerating assembly 10 can be operatively associated.

The SKS Carbine 12 has a stock 16 which supports a combined receiver and barrel assembly 18. That is, the combined receiver and barrel assembly 18 has a receiver housing 20 to which the barrel 22 is threadably secured. Before proceeding with the description of the present invention, it is to be noted that use of the term "stock" is employed throughout the specification for convenience, because the SKS Carbine does employ a stock. Generally speaking, the stock of a rifle is the component that holds and/or receives the barrel, receiver and trigger assembly. Nevertheless, there are firearms that employ various supporting devices as an alternative to an otherwise conventional stock. Hence, use of the term stock throughout this specification is made with the understanding that it connotes all forms of stocks irrespective of their shape and materials, as well as other devices that hold the barrel, receiver and trigger assembly—le., supporting devices.

Figure 6:
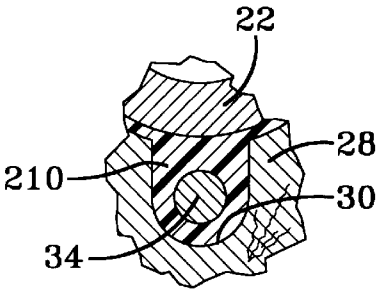
FIG. 6 is an enlarged, transverse section taken substantially along line 6—6 of FIG. 4.
Figure 5:
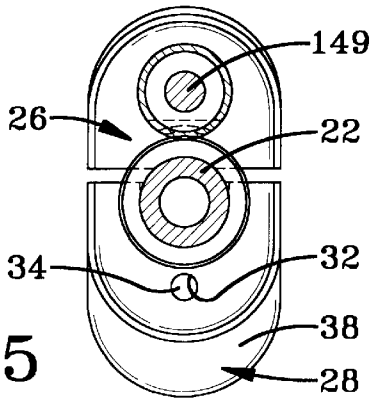
FIG. 5 is a transverse section taken substantially along line 5—5 of FIG. 4.

A gas plug 24 and a connecting ferrule 26 are tightly secured to the barrel 22. The fore-end of an SKS Carbine stock that has not been modified to accept the accelerating assembly 10 is anchored to the connecting ferrule 26. Specifically, the fore-end 28 of the stock 16 has a longitudinally oriented, storing notch 30 that is aligned with a circular aperture 32 which penetrates the connecting ferrule 26. In some stocks the notch may be a cylindrical bore, but generally the stock, and particularly if made of wood, is simply longitudinally recessed with a notch 30, as best seen in FIG. 6. Composite stocks are also generally notched, as by notching the normally employed transverse reinforcing ribs, but some composite stocks utilize a cylindrical bore that extends longitudinally within the fore-end. Irrespective of how the storing arrangement is constructed, a cleaning rod (not shown) is customarily inserted through the aperture 32 for storage within the notch 30 in the fore-end 28 of the stock 16.

As will be hereinafter more fully described, in modifying the stock of an SKS Carbine 12 to accept the accelerating assembly 10, the fore-end 28 of the stock 16 is shortened to terminate in spaced relation rearwardly of the ferrule 26, and a guide rod 34 is permanently secured within the storing notch 30 that was provided for the cleaning rod. The guide rod 34 extends longitudinally from the notch 30 in the fore-end 28 of the stock 16 through the aperture 32 in the connecting ferrule 26, and a compression spring 36 circumscribes the guide rod 34 to be interposed between the face 38 of the fore-end 28 and the connecting ferrule 26 for a purpose that is also hereinafter more fully described. To minimize wear to the face 38 by action of the compression spring 36—which may most likely be encountered with wood stocks—a washer (not shown) may be interposed between the face 38 and the adjacent end of the compression spring 36. However, wear to the face 38 is not generally encountered, even with wood stocks 16.

SKS Trigger Assembly

Figure 3:
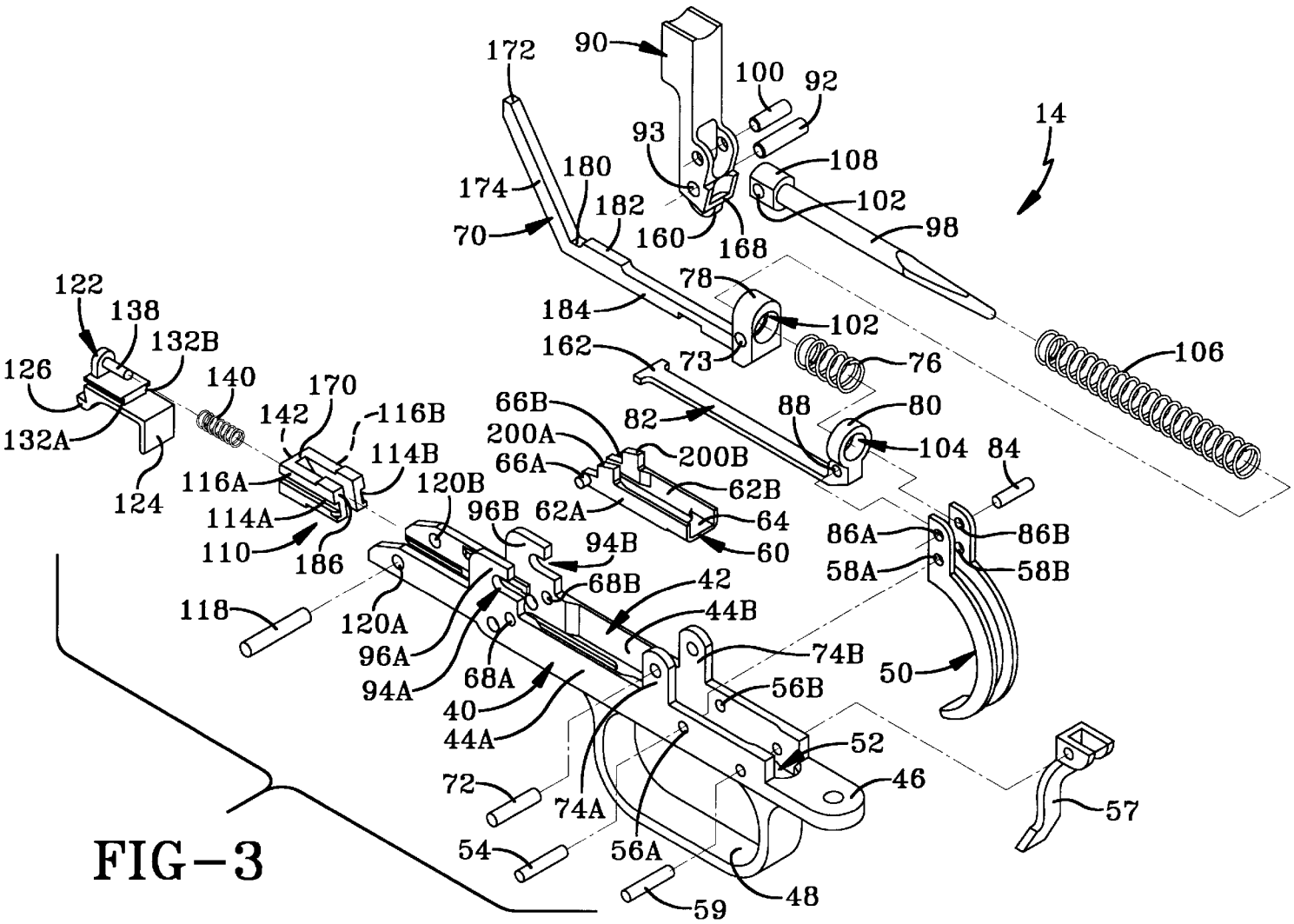
FIG. 3 is an enlarged, exploded perspective of the standard SKS trigger assembly depicted in side elevation on FIG. 2.

As is, perhaps, most clearly depicted in FIG. 3, the trigger assembly 14 includes a frame member 40 having an upwardly directed channel cavity 42 delineated by side walls 44A and 44B that extend upwardly from a base plate 46. A trigger guard, or bow, 48 extends downwardly from the under side of the base plate 46. The trigger 50 extends upwardly through an aperture 52 in the base plate 46 to be secured by a trigger pin 54 that extends across the channel cavity 42 to be supported in aligned bores 56A and 56B which penetrate the side walls 44A and 44B, respectively. The trigger pin 54 extends through transverse mounting bores 58A and 58B in the trigger 50. Operation of the trigger 50 is accomplished by selectively engaging the trigger finger on the shooter's hand with the trigger 50 in order to pivot the trigger 50 on the trigger pin 54. A safety pivot pin 59 is also supported from the side walls 44A and 44B, but the operation of the safety 57 which is mounted on safety pin 59 is not germane to the operation of the accelerating assembly 10 or the fire control mechanism per se, and the operation of the safety 57 is not, therefore, described herein.

A generally U-shaped auxiliary, or rebound, disconnector 60 lies within the channel cavity 42 of the trigger assembly frame member 40. Some writers, and ordnance armorers, refer to the auxiliary disconnector 60 as a pressure plate, but irrespective of what it is called, the auxiliary disconnector 60 has legs 62A and 62B which extend, in laterally spaced relation, longitudinally forwardly from a transverse web plate 64. The legs 62 and web plate 64 thus define a U-shaped configuration which opens forwardly. The auxiliary disconnector 60 is retained by mounting bosses 66A and 66B which extend laterally from the forward portion of the respective legs 62A and 62B to be supportingly received within appropriate bores 68A and 68B in the opposed side walls 44A and 44B to define the pivotal axis for the auxiliary disconnector 60. It should be noted that to save expense some manufacturers totally eliminate the auxiliary disconnector 60, but it is included in the present discussion in order to show that the use of the accelerating assembly 10 does not adversely impact upon, or negate, the operation of the auxiliary disconnector 60, should one be employed.

A primary disconnector 70 is pivotally mounted on a pin 72 that extends through a bore 73 in the head portion 78 of the primary disconnector 70 to be supportingly received within an opposed pair of extension arms 74A and 74B which extend upwardly from the side walls 44A and 44B, respectively, of the trigger assembly frame member 40. The primary disconnector 70 is mounted above the auxiliary disconnector 60 but is pivotally movable vertically between the laterally spaced legs 62 of the U-shaped, auxiliary disconnector 60. One end of a compression, trigger transfer bar/disconnector spring 76 is anchored within the head portion 78 of the primary disconnector 70 and the opposite end of the compression trigger transfer bar/disconnector spring 76 is anchored within an aligned head portion 80 on a trigger transfer bar 82. The trigger transfer bar 82 is disposed beneath the auxiliary disconnector 60, and a connecting pin 84 pivotally connects the trigger transfer bar 82 to the trigger 50. The pin 84 is received through second transverse bores 86A and 86B in the trigger 50 and a transverse coupling bore 88 in the trigger transfer bar 82 such that pivotally depressing the trigger 50 rearwardly extends the trigger transfer bar 82 forwardly. However, it must be observed that the trigger transfer bar/disconnector spring 76 continuously biases the trigger transfer bar 82 to pivot about the connecting pin 84 independently of the primary and auxiliary disconnectors 70 and 60, respectively, for a purpose more fully hereinafter explained.

A hammer 90 is pivotally mounted to the trigger assembly frame member 40 by a hammer pin 92 that extends laterally through a bore 93 in the hammer 90 to be received within a pair of rearwardly opening slots 94A and 94B that are defined by opposed stanchion plates 96A and 96B which extend upwardly from the side walls 44A and 44B, respectively, of the trigger assembly frame member 40.

A hammer strut 98 is pivotally mounted to the hammer 90, as by a pin 100 that extends through a transverse bore 101 in the head portion 108 of the hammer strut 98 to be received in aligned bores 103A and 103B in the hammer 90. The hammer strut 98 extends rearwardly through the central aperture 102 in the head portion 78 of the primary disconnector 70, longitudinally through the helical trigger transfer bar/disconnector spring 76 and through a central aperture 104 in the head portion 80 of the trigger transfer bar 82. A hammer spring 106 circumscribes the hammer strut 98 and extends between the head 108 of the hammer strut 98 and the head portion 78 of the primary disconnector 70. As such, the hammer spring 106 is not only operative forcefully to drive the hammer 90 (as will be hereinafter more fully described) but the hammer spring 106 also serves directly to bias the primary disconnector 70 pivotally about pin 72 (as will also be hereinafter more fully described) and indirectly to assist in biasing the trigger transfer bar 82 about pin 84.

A sear block 110 is slidably mounted on a pair of tongues 112A and 112B (best seen in FIG. 2B) that extend, in opposition, into the U-shaped channel cavity 42 from the side walls 44A and 44B of the trigger assembly frame member 40. The tongues 112A and 112B are, respectively, received in grooves 114A and 114B (FIG. 3) which are recessed within, and extend longitudinally along, the side faces 116A and 116B of the sear block 110. The sear block 110 is thus slidable along the tongues 112, and the sear block 110 is retained within the frame member 40 by a cross pin 118 that extends transversely through aligned bores 120A and 120B in the respective side walls 44A and 44B of the trigger assembly frame member 40.

The cross pin 118 serves three functions. The first two of those three functions are: 1) it retains the sear block 110 within the trigger assembly frame member 40; and, 2) simultaneously, it retains the magazine catch member 122 within the trigger assembly frame member 40. By way of its third function, as will be hereinafter more fully explained, the end portions of the cross pin 118 extend laterally outwardly from the side plates 44 of the trigger assembly frame member 40 and are thereby employed to mount the trigger assembly 14 to the combined receiver and barrel assembly 418.

The magazine catch member 122 may be operable by a magazine catch release lever (not shown) that may be mounted on the trigger assembly frame member 40. Or, as shown, a finger engaging flange 124 may extend downwardly from the rearward portion of the catch member 122, and a catch 126 may extend downwardly from the forward portion of the catch member 122 releasably to engage a mating latch rib 128 (FIG. 2) on the magazine 136. The catch member 122 is itself slidable longitudinally within the channel cavity 42 by the engagement of opposedly disposed rails 130A and 130B (FIG. 2A) which extend toward each other from the lower edges of the side walls 44A and 44B, respectively, of the trigger assembly frame member 40. The rails 130A and 130B are slidably received within channels 132A and 132B (FIG. 3) on the sides of the catch member 122. As such, the cross pin 118 is often referred to as the "sear/magazine-catch stop pin."

An aligning post 138 is cantilevered from, and extends rearwardly with respect to, the magazine catch member 122 to position, and retain, a sear spring 140 which engages the forward face 142 of the sear block 110 continuously to bias the sear block 110 rearwardly.

Operation of Trigger Assembly

Figures 2, 2D:
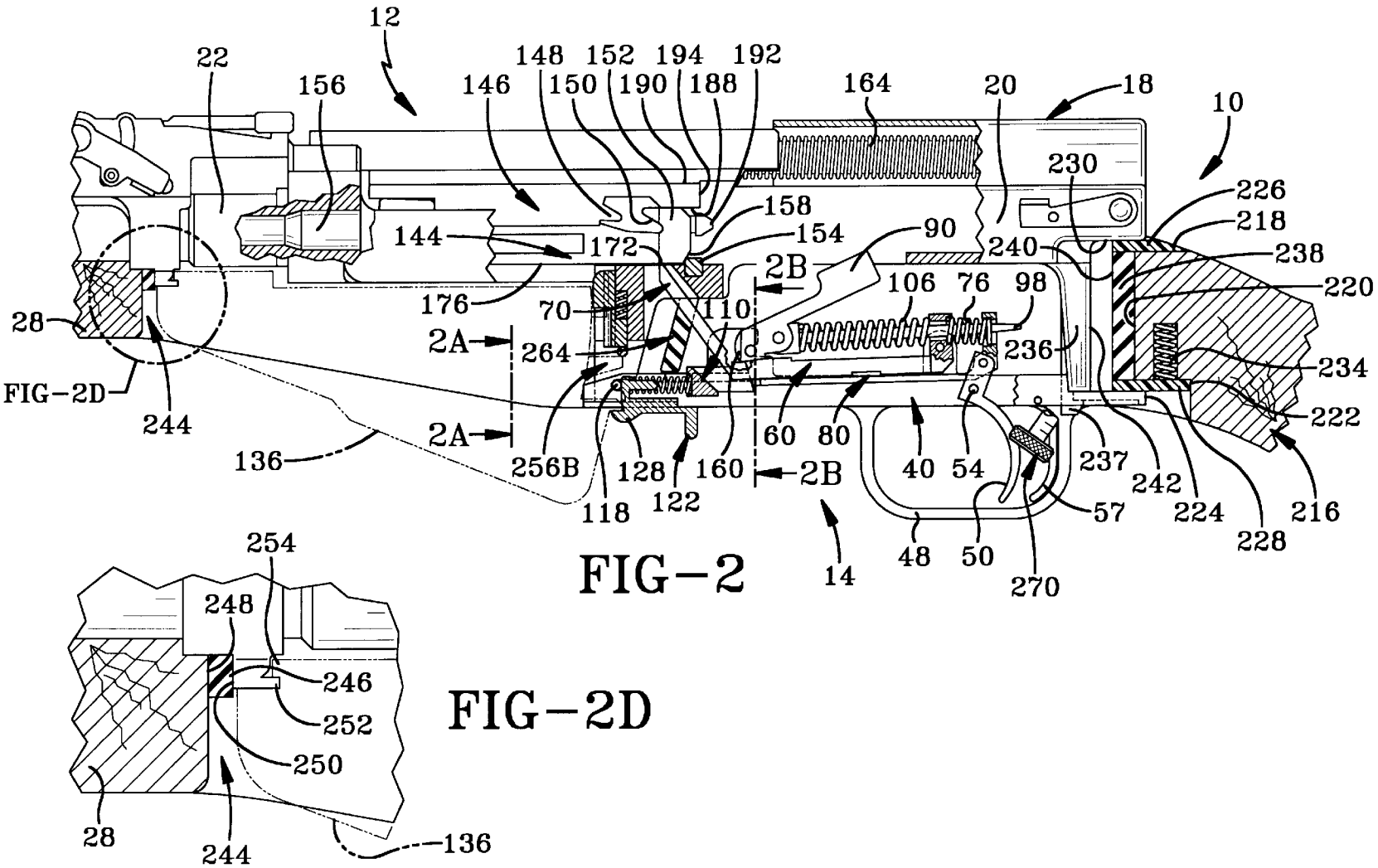
FIG. 2 is an enlarged area of FIG. 1 delineated by the chain-line rectangle designated as "FIG. 2" on FIG. 1—FIG. 2 being partially broken way and partially in section and with the magazine represented in phantom to facilitate understanding of the assembled mechanism comprising the trigger assembly and yet to depict the structural relationship between the receiver and barrel assembly, the magazine, the trigger assembly and the stock.
FIG. 2D is an enlarged area of FIG. 2 delineated by the chain-line circle designated as "FIG. 2D" on FIG. 2 to depict a return bumper, FIG. 2D appearing on the same sheet of drawings as FIG. 2.

To understand the operation of the trigger assembly 14 one must completely understand the interaction between the bolt 144, the bolt carrier 146 and the receiver housing 20, as best seen in FIG. 2, together with the interaction between those components and the previously described trigger assembly 14.

As such, when the bolt 144 is moved rearwardly—by the rearward movement of the bolt carrier 146 in response to the movement of the gas driven piston 147 (FIG. 4) and operating rod 149 (normally in two pieces, not shown) when the firearm is discharged—a rearwardly directed lug 148 (FIG. 2) on the lower rear portion of the bolt carrier 146 engages a cam 150 presented from an opposed lug 152 that extends upwardly from the rear of the bolt 144. That engagement, in conjunction with the rearward movement of the bolt carrier 146 raises the rear of the bolt 144 above the level of the cross bar 154 secured to the receiver body 20 and allows the bolt 144 to move rearwardly with the bolt carrier 146 in order to extract and eject the spent round in the chamber 156 of the barrel 22. This same rearward movement of the bolt 144 brings the lower, rear face 158 of the bolt 144 into engagement with the hammer 90 to rotate the hammer 90 on the hammer pin 92 to the cocked position.

Figure 2C:
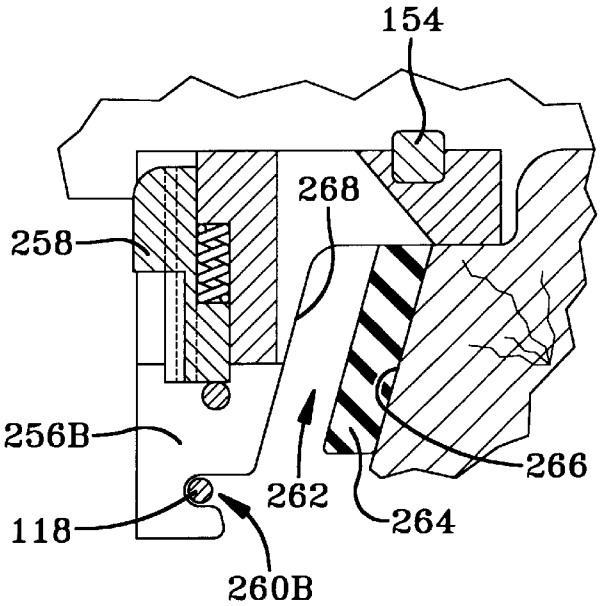
FIG. 2C is a vertical section taken substantially along line 2C—2C of FIG. 2A to depict the relationship of a stirrup with respect to its recoil bumper.
Figure 2B:
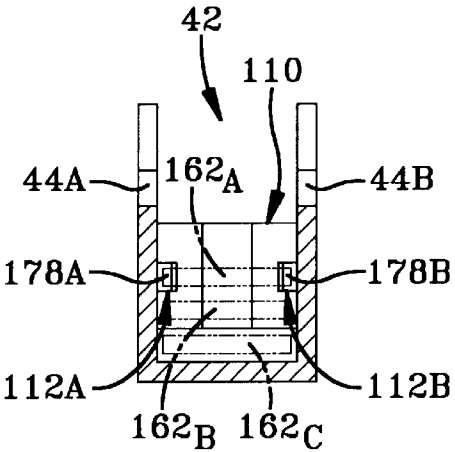
FIG. 2B is an enlarged view taken substantially along line 2B—2B of FIG. 2 not only to depict the sear block in rear elevation but also to detail the slidable mounting of the sear block in the trigger assembly frame member.

The process of cocking the hammer 90 forces a sagittal rib 160 (FIG. 3) on the lower portion of the hammer 90 against the trigger transfer bar 82 to pivot the trigger transfer bar 82 about its connecting pin 84 and thereby drive the forward end 162 of the trigger transfer bar 82 beneath the sear block 110—i.e.: to position $\mathbf{162}_C$ shown in FIG. 2B. With the forward end 162 of the trigger transfer bar 82 thus forced downwardly, the sear block 110 is able to move longitudinally rearwardly above the forward end 162 of the trigger transfer bar 82 by the biasing action of the sear spring 140. As the bolt 144 reverses its direction to move forwardly under the impetus of the bolt return spring 164 (located rearwardly of, and partially received within, the bolt carrier 146), the sear engaging surface 168 on the hammer 90 will normally engage the sear surface 170—the upper rearward face of sear block 110—to prepare the hammer 90 for the next firing sequence.

As the bolt 144 is thus moving forwardly under the impetus of the bolt return spring 164, the bolt 144 strips a live cartridge from the magazine 136 and drives it into the chamber 156. Only when the bolt 144 is in its fully forward position—i.e.: in battery—will it drop in front of the cross bar 154 to permit the bolt carrier 146 to continue to move forwardly. If the bolt 144 does not drop into position in front of the cross bar 154, the primary disconnector 70 will not pivot about its support pin 72. That is, the outer end 172 of the dog-leg extension 174 on the primary disconnector 70—which engages the underside 176 of the bolt 144 by virtue of the continuous biasing action of the hammer spring 106 against the head portion 78 of the primary disconnector 70—will not be depressed by the action of the bolt 144 dropping in front of the cross bar 154 when the bolt is fully "in battery." Thus, even if the trigger 50 is released—which allows the forward end 162 of the trigger transfer bar 82 to move longitudinally rearwardly of the sear block 110 in preparation for the next firing sequence—unless the primary disconnector 70 is pivoted by engagement with the bolt 144, the biasing action of the hammer spring 106 and the trigger transfer bar spring 76 raises the forward end 162 of the trigger transfer bar 82 such that it will engage the opposed, rearmost blocking ends 178A and 178B, respectively, of the tongues 112A and 112B that extend toward each other from the laterally spaced side walls 44A and 44B of the trigger assembly frame member 40. Those tongues 112 thus preclude engagement between the forward end 162 of the trigger transfer bar 82 and the sear block 110. That is, the forward end 162 is in position $\mathbf{162}_A$ as shown in FIG. 2B. Unless the trigger transfer bar 82 can displace the sear block 110 forwardly, the hammer 90 is restrained from rotating about the hammer pin 92.

It should also be noted that the primary disconnector 70 also has a sear notch 180 (FIG. 3) that is located at the forward extent of an engaging hump 182 which extends upwardly from the linear body portion 184 of the primary disconnector 70. Hence, even if the forward end 162 of the trigger transfer bar 82 does engage the rear face 186 of the sear block 110 and is not blocked by the rearmost blocking ends 178 of the sear block engaging tongues 112 (i.e.: position $\mathbf{162}_B$ depicted in FIG. 2B)—as might occur if the bolt carrier 146 did not move to its fully closed position and the rear of the bolt 144—though it had been initially in position in front of the cross bar 154—were to raise after the trigger transfer bar 82 had begun to translate the sear block 110. The sear notch 180 on the primary disconnector 70 will preclude the hammer 90 from falling, even though the sear block 110 itself might move sufficiently forwardly to disengage the hammer 90. This is an excellent example of the operational safeguards achieved by the complexity of the fire control system built into the trigger assembly 14 of the SKS Carbine.

It should be further appreciated that even if the primary disconnector 70 is engaged by the bolt 144 (signaling that the bolt 144 is in position to fire), a locator surface 188 on the rear, underside of the bolt carrier 146 must slide along the upper surface 190 of the bolt lug 152 a sufficient distance to permit the hammer 90 to engage the firing pin 192. Hence, if the bolt carrier 146 is not fully forward, the hammer 90 will fall, but it will not engage the firing pin 192. Rather, the hammer 90 will engage the rearmost surface 194 of the bolt carrier 146—which precludes engagement between the hammer 90 and the firing pin 192. It should be emphasized that the safety features described above are directed to assuring that the carbine will not fire until the bolt 144 and the bolt carrier 146 are both in the fully forward, closed position.

Turning now to fire control relating to the assured disconnection of the trigger transfer bar 82 from the sear block 110, the first arrangement involves the release effected during the fall of the hammer 90. That is, even though the trigger 50 remains squeezed to the fire position, as the hammer 90 falls the sagittal rib 160 on the hammer 90 engages the hump 182 on the body portion 184 of the primary disconnector 70 which drives the forward end 162 of the trigger transfer bar 82 beneath the sear block 110 (to position $\mathbf{162}_C$ in FIG. 2B)—thus allowing the sear block 110 to be biased, by sear spring 140, rearwardly over the forward end 162 of the trigger transfer bar 82 so that the sear engaging surface 168 on hammer 90 will be pressed into contact with the sear surface 170 on the sear block 110 as the hammer 90 is pivoted by the bolt 144 to the cocked position.

Even if disengagement between the forward edge 162 of the trigger transfer bar 82 and the rear face 186 of the sear block 110 should not be effected as the hammer 90 falls, when the hammer 90 is returned to its over-cocked position, the hammer sear engaging surface 168 will engage the lateral spurs 200A and 200B on the auxiliary disconnector 60 to depress the trigger transfer bar 82 by interaction between the web plate 64 on the auxiliary disconnector 60 and the trigger transfer bar 82 so as to move the forward end 162 downwardly a sufficient distance to disengage the rear face 186 of the sear block 110—i.e.: to position $\mathbf{162}_C$ in FIG. 2B. Thus, even a further built-in safety arrangement has been provided to preclude inadvertent, fully automatic fire.

Modification of an SKS Carbine Stock to Incorporate an Accelerating Assembly

Figure 4:
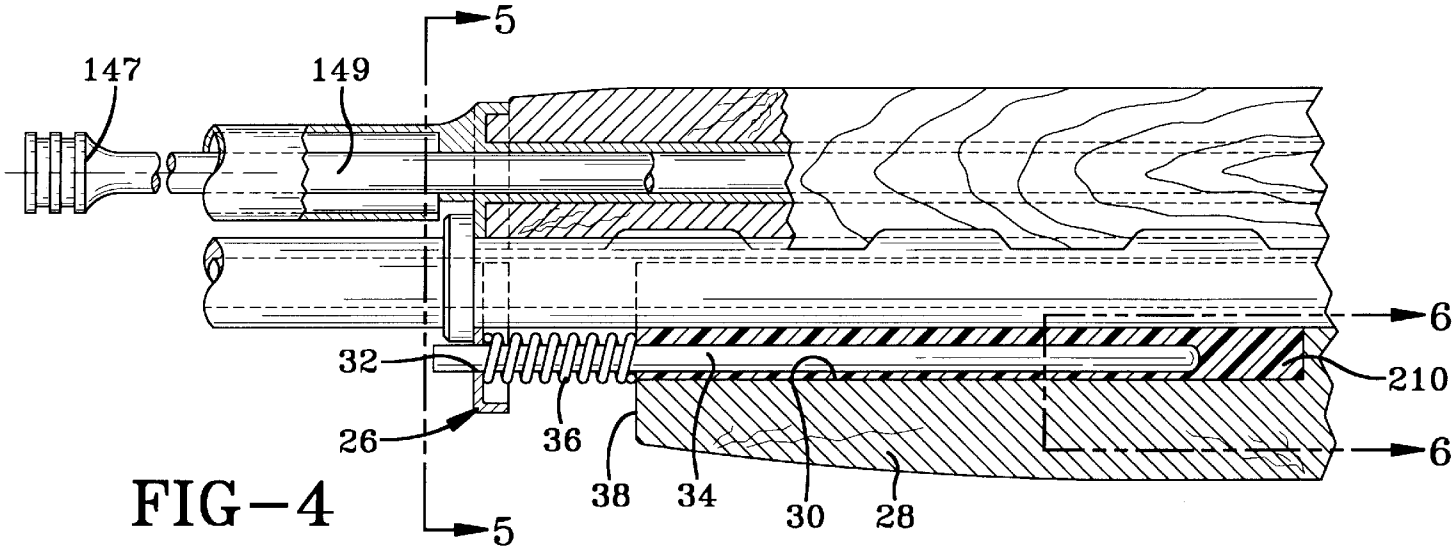
FIG. 4 is an enlarged side elevation, also partially broken away and partially in longitudinal section, taken within that area of FIG. 1 delineated by the chain-line rectangle identified as "FIG. 4" on FIG. 1.

With more specific reference to FIGS. 1 and 4, the frontal portion of the fore-end 28 of the stock 16 is removed to leave a space of approximately 1½ inches between the face 38 of the fore-end 28 and the connecting ferrule 26. The guide rod 34 is permanently secured within the storing notch 30 such that the rod 34 protrudes through the circular aperture 32 in the connecting ferrule 26 to extend approximately two inches therebeyond. The compression spring 36 serves to urge the combined receiver and barrel assembly 18 forwardly after having been moved rearwardly in response to the recoil resulting from the firing of each successive round.

With particular reference to FIGS. 4 and 6, a bedding material 210 circumscribes the rod 34 and may be interposed between the fore-end 28 of the stock 16 and the barrel 22. The bedding material 210 may be a fiber reinforced plastic (FRP) which adheres to the surface of the storing notch 30 and may conform to the lower surface of the barrel 22 in order to provide a bearing surface along which the barrel 22 and the bedding insert 210 may reciprocate longitudinally, one with respect to the other. The desired relative reciprocation may be enhanced by making the bedding 210 of a material that has a low coefficient of friction, and that criterion is fully satisfied by many currently known FRP materials.

With reference now to FIG. 2, it can be observed that the forward end 216 of the butt stock—historically that portion of the butt stock was referred to as the "pistol grip" even though both the inner and outer ends of the pistol grip were an integral portion of the stock—has been relieved, as at 218, 220 and 222, to accommodate the reciprocation of the receiver housing 20 as well as the rear extension 224 of the base plate 46, respectively. The relieved portions 218 and 222 are respectively covered with a bearing insert 226 and 228 to allow the stepped, rear undersurface 230 of the receiver housing 20 as well as the rearward extension 224 of the base plate 46 to slide rearwardly thereupon. Like the bedding material 210, the bearing inserts 226 and 228 should be made of a material having a low coefficient of friction. However, being inserts one could employ strips of, for example Teflon. However, Teflon is identified merely by way of example; any suitable bearing material may be substituted for Teflon without departing from the scope of the invention.

The lower bearing insert 228 may be penetrated by an aperture (not shown) through which a trigger guard spring 234 may extend to engage the rearwardly directed extension 224 from the base plate 46 of the trigger assembly frame member 40. However, in many versions of the SKS Carbine the trigger guard spring 234 is located too far forwardly to accommodate the required rearward translation of the take-down latch support bracket 236 or too far rearwardly (as shown) to allow the required rearward translation of the rear extension 224 without impacting adversely on the trigger guard spring 234. As such, one may elect simply to have the trigger guard spring 234 apply its biasing pressure, as shown, against the bearing insert 228 which, in turn, translates the biasing pressure to the extension 224. In either construction, the spring 234, if used, should present sufficient force to the extension 224 that the base plate 46 will be forced downwardly in order firmly to engage the take-down latch 237 supported on the bracket 236.

In order to permit the combined receiver and barrel assembly 18 to reciprocate with respect to the stock 16, in addition to the aforesaid bearing inserts 226 and 228, provision must be made to obviate interference between the stock 16 and the combined receiver and barrel assembly 18 as well as the trigger assembly 14. Typically, the entire rearward movement of the trigger 50, including the take-up movement, will be between one-quarter (¼) and one-half (½) of an inch. On that basis approximately one-half (½) of an inch relative movement of the trigger 50 rearwardly of the trigger finger (with the trigger finger remaining stationary) will move the trigger out of contact with a fixedly located trigger finger and thereby permit full actuation of the fire control mechanism required to effect the cyclic fire control mechanism of the SKS Carbine. As such, although the relieved portion of the stock 16 at 218 and 222 need merely be of the dimension required to accommodate the thickness of the bearing inserts 226 and 228, the relieved portion of the stock at 220 must be sufficient not only to accommodate a first recoil bumper 238 but also be sufficient to accommodate as much as about one-half (½) of an inch relative movement between the forwardly facing surface 240 of the recoil bumper 238 mounted on the relieved surface 220 and the rear face 242 of the take-down latch support bracket 236 which extends downwardly from the stepped rear undersurface 230 of the receiver housing 20.

As such, one should employ a material that is sufficient resilient to accommodate the required rearward movement of the combined receiver and barrel assembly 18 while greatly absorbing the recoil shock so as to preclude deleterious pounding to the relieved surface 220 of the butt portion of stock 16. Rubber and polyvinyl chloride (PVC) are two materials that can be formulated to provide elasticity to withstand the range of the shock recoil imposed by firing the firearm. That is, the recoil bumper 238 must deform to provide the desired translation of the trigger in order to reset the firing mechanism without suffering permanent deformation that would inhibit successive discharges of the firearm.

With reference now to FIG. 2, a portion of the stock fore-arm 28 rearwardly of the guide rod 34 is relieved, as at 244, to allow mounting of a first, resilient, shock-absorbing, return bumper 246 between the rear face 248 of the relieved portion 244 and the forward surface 250 of an anchor hook 252 which projects downwardly from the barrel 22 to receive the forward mounting flange 254 of the magazine 136.

Figure 2A:
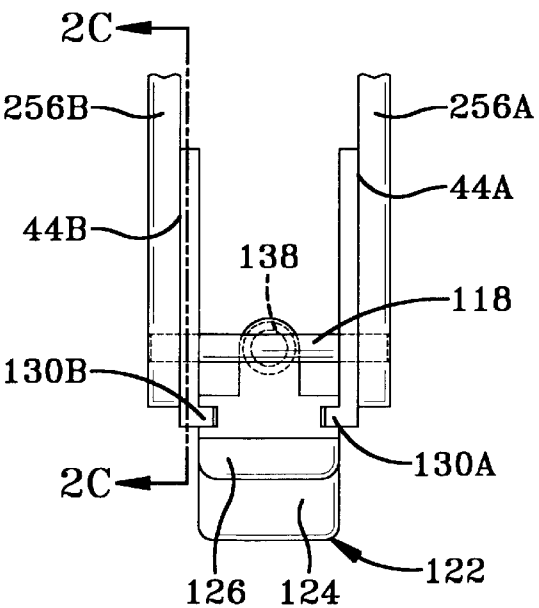
FIG. 2A is an enlarged view taken substantially along line 2A—2A of FIG. 2 to depict the magazine catch member in frontal elevation and simultaneously to detail the slidable mounting of the magazine catch member in the trigger assembly frame member.

Turning now to FIG. 2A, it will be observed that a pair of laterally spaced stirrups 256A and 256B extend downwardly from the receiver housing 20 just rearwardly of the magazine 136. In fact, the magazine follower 258 (FIG. 2C) is mounted for vertical reciprocation between the stirrups 256. The end portions of the cross pin 118—which extend laterally outwardly from the side walls 44 of the trigger assembly frame member 40 are received in rearwardly directed locating notches 260A and 260B presented from the lower extremities of the respective stirrups 256A and 256B, as best seen in FIGS. 2A and 2C. Normally, the side walls, as well as the rear edges, of the stirrups 256 are embraced by the wood of the stock 16. However, to accommodate the longitudinal reciprocation of the combined receiver and barrel assembly 18, the wood of the stock 16 must be relieved, as at 262 to permit the desired rearward movement of each stirrup. Second recoil bumpers 264 are positioned along the rear edge 266 of each relieved portion 262 to be engaged by the rear edges 268 of each stirrup 256. The second recoil bumper may be of the same material as the first recoil bumper 238.

During the recoil occasioned by each firing sequence, the trigger assembly 14—and the combined receiver and barrel assembly 18 from which the trigger assembly 14 is supported—reciprocates rearwardly away from and then forwardly back to the return bumper 246. In other words, the shock absorbing aspect of the bumper 246 comes into play as the combined receiver and barrel assembly 18, with the conjoined trigger assembly 14, returns to the "at rest" position. Conversely, the first and second recoil bumpers 238 and 264 are employed to obviate the shock imparted by the rearward translation of the combined receiver and barrel assembly 18, and associated components, with respect to the stock 16.

Figure 1A:
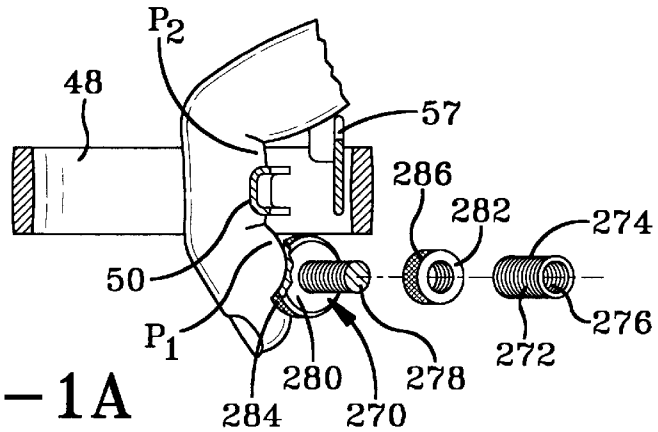
FIG. 1A is an enlarged, transverse section, partially exploded, which is taken substantially along line 1A—1A of FIG. 1 to depict the interaction of the trigger finger with both the trigger and the stop means employed by an accelerating assembly embodying the concepts of the present invention.

One form of a stop means 270 included in the accelerating assembly 10 may have an annular bushing 272 with a connecting means, such as threads 274, on the cylindrical outer surface of the annular bushing 272 and adjusting means, which may also be threads 276, on the cylindrical inner surface of the annular bushing 272. The bushing 272 may (for right handed shooters) be permanently installed in the stock 16 on the left side of the trigger guard 48. A machine screw 278 having a concave head 280 matingly engages the threads 276 on the cylindrical interior surface of the annular bushing 272 to permit longitudinal adjustment of the concave head 280 relative to the stock 16. A lock nut 282 may be employed to secure the selected location for the concave head 280. The stop means 270 is disposed to permit the concave head 280 to be selectively located generally longitudinally of the stock 16 and within a relatively small range laterally of the trigger 50. The lateral spacing should, as shown in FIG. 1A, be such that if the pad $P_1$ over the distal phalanx of the shooter's fore, or trigger, finger engages the concave head 280, the pad $P_2$ over the middle phalanx of the shooter's fore, or trigger, finger will engage the trigger 50. To facilitate adjustment of the machine screw 278 the circumferentially outer surface of the concave head 280 may be knurled, as at 284. The circumferentially outer surface of the lock hut 282 may be similarly knurled, as at 286, for the same purposes.

For the accelerating assembly 10 to operate, the middle pad $P_2$ must depress the trigger 50 sufficiently to actuate the firing sequence as the pad $P_1$ comes into firm engagement with the concave head 280. With the butt of the stock 16 firmly engaged with the shooter's shoulder, or with the pistol grip 216 of the stock 16 firmly grasped by the hand on which the trigger finger is located, the trigger 50 will translate rearwardly with the recoil action of the combined receiver and barrel assembly 18 to disengage the trigger 50 from the pad $P_2$ and allow the trigger 50 to rotate sufficiently to permit the trigger assembly 14 to reset in preparation for the initiation of the next firing cycle. As the trigger 50 then translates forwardly with the combined receiver and barrel assembly 18, the trigger 50 will re-engage the pad $P_2$ to fire the next round. This cycle will continue so long as the trigger finger remains immobilized by the stop means 270 and so long as unfired cartridges are fed from the magazine 136 into the chamber 156.

Should the shooter wish to reduce the firing cycle so as to require a conscious depression of the trigger 50 for firing each round, the shooter need simply depress the trigger with pad $P_1$. So actuated the trigger mechanism will continue to require a release of the trigger 50 and re-depression thereof but by a voluntary, conscious action of the shooter's trigger finger rather than by the involuntary action of the trigger 50 moving rearwardly away from, and then sequentially forwardly into engagement with, an immobilized trigger finger.

Even though the cyclic rate of fire is markedly enhanced when the trigger finger is immobilized, it must be appreciated that the trigger 50 must be depressed to fire each round, and as such the semi-automatic status of the SKS Carbine 12 remains unchanged irrespective of whether the shooter engages only the trigger 50 with the trigger finger or engages both the trigger 50 and the stop 270, as previously explained.

It should be readily apparent that one may as easily mount the stop means 270 on the right side of the trigger guard 48 in order to allow a left handed shooter to operate the accelerating assembly 10 as easily as a right handed shooter.

The inventive concept heretofore disclosed allows the owner of a standard SKS Carbine to remove the receiver group, including the trigger assembly, from the standard stock with all of its mechanism intact, insert that arrangement in a modified stock and begin shooting. In contrast with some of the prior art which attempt to accelerate the semi-automatic action, this device does not shake the shooter into erratic firing. It actually eliminates any aberration of the aiming process with its gentler recoil action and, in fact, enables the shooter to produce a fairly precise pattern of hits.

One Variation of the Accelerating Assembly for an SKS Carbine

Figure 7:
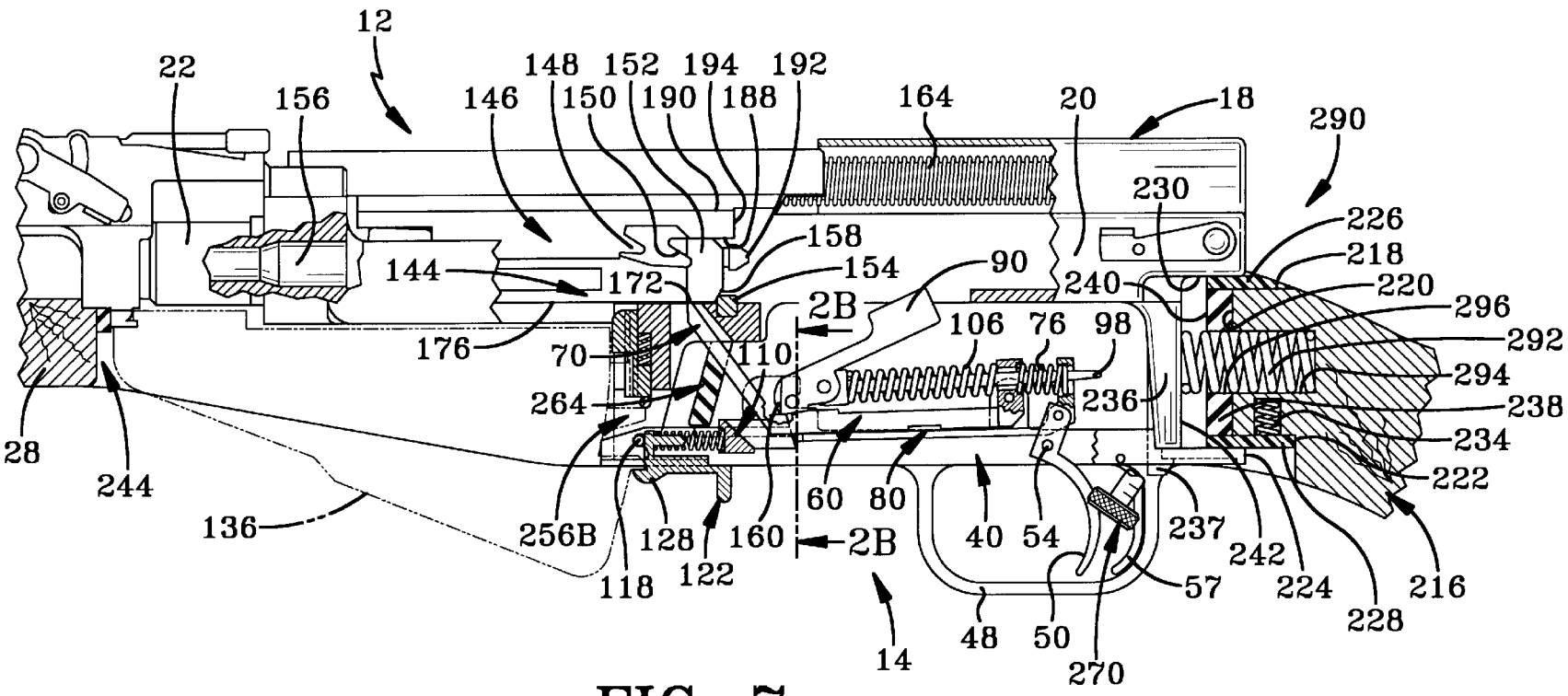
FIG. 7 is a view similar to FIG. 2 but depicting an alternative structural arrangement between the rear of the receiver and barrel assembly and the stock.

Although the compression spring 36 works quite well to achieve the desired operation of the accelerating assembly 10 it must be appreciated that a variation of the accelerating assembly 290, as shown in FIG. 7 substitutes a compression spring 292 that is anchored in a recess 294 provided in the pistol grip 216 and which opens through relieved surface 220 in alignment with an aperture 296 that penetrates the recoil bumper 238 to engage the rear face 242 of the take-down latch support bracket 236.

Either compression spring 36 or compression spring 292 work quite successfully without the other, but they may also be employed in concert. It should be noted, however, that the combined receiver and barrel assembly 18 is more easily installed in a modified stock 16 adapted to use only the compression spring 36 rather than the compression spring 292, either alone or in concert with the spring 36.

A Second Variation of the Accelerating Assembly for an SKS Carbine

Figure 9:
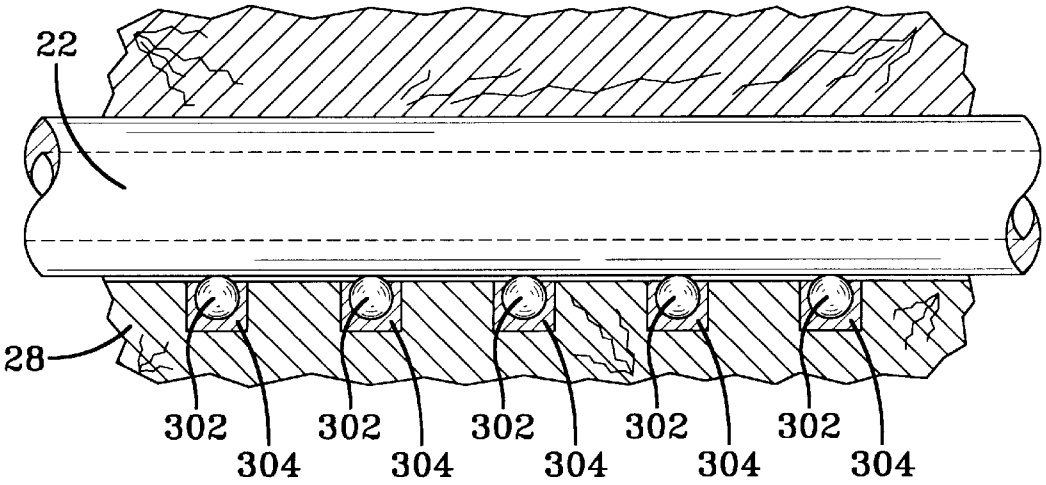
FIG. 9 is a longitudinal section taken substantially along line 9—9 of FIG. 8.
Figure 8:
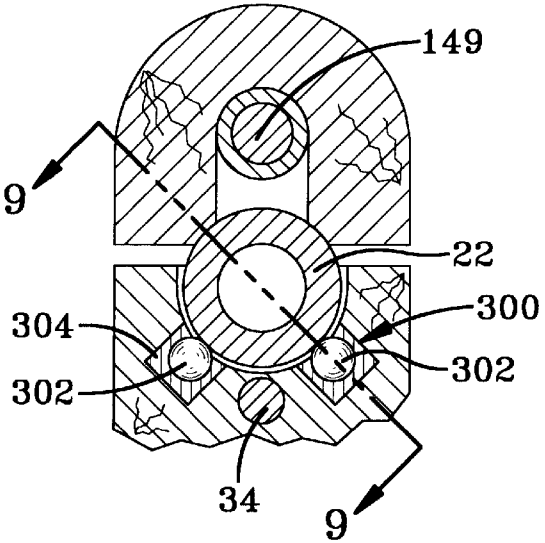
FIG. 8 is a view similar to FIG. 6 depicting a first variation of the structural engagement between the barrel and the fore-end of the stock.

Although the bedding insert 210 has been found to work quite well, one might consider the use of a rotating bearing interface 300 as a substitute—particularly if the firearm is intended for rapid fire cycle over extended periods of time. Thus, in order severely to reduce the heat produced by the frictional interaction between a barrel 22 that is rapidly warming by simply being fired and the bedding insert 210, one may well utilize bearings such as needle bearings or the ball bearings 302 depicted in FIGS. 8 and 9. As shown, each ball bearing 302 may be rotatably supported within an individual cup-race 304, or a plurality of ball bearings may be supported in a pair of linear races (not shown) or a desired number of semi-annular races (also not shown).

Conclusion Relative to the SKS Carbine

The foregoing description of the several exemplary embodiments of the present invention as applied to an SKS Carbine have been presented for the purposes of illustration and description. The foregoing description is not intended to be exhaustive or to limit the invention to the precise form disclosed. Obvious modifications or variations are possible in light of the above teachings. The embodiments described were chosen and described to provide the best illustration of the principles of the invention and its practical application in order to enable one of ordinary skill in the art to utilize the invention and various embodiments thereof with, or without the various modifications, as are suited to the particular use contemplated. All such variations and modifications are within the scope of the invention as determined by the appended claims when interpreted in accordance with the breadth to which they are fairly and legally entitled.

The essence of this inventive concept lies in the fact that in the construction of the standard SKS Carbine 12, the combined receiver and barrel assembly 18 is rigidly attached to the standard stock 16, which causes a significant recoil of the entire firearm each time the trigger is pulled. By relieving certain parts of the stock, as heretofore described, the combined receiver and barrel assembly, and the mechanism supported therefrom, recoils no more than approximately one-half (½) an inch within the stock, thereby lessening the actual recoil imparted to the shooter. This factor is an added benefit to the shooter, even though it is not the primary object of this invention.

Introduction to the Firing Control Mechanism of a MAK-90

Figure 10:
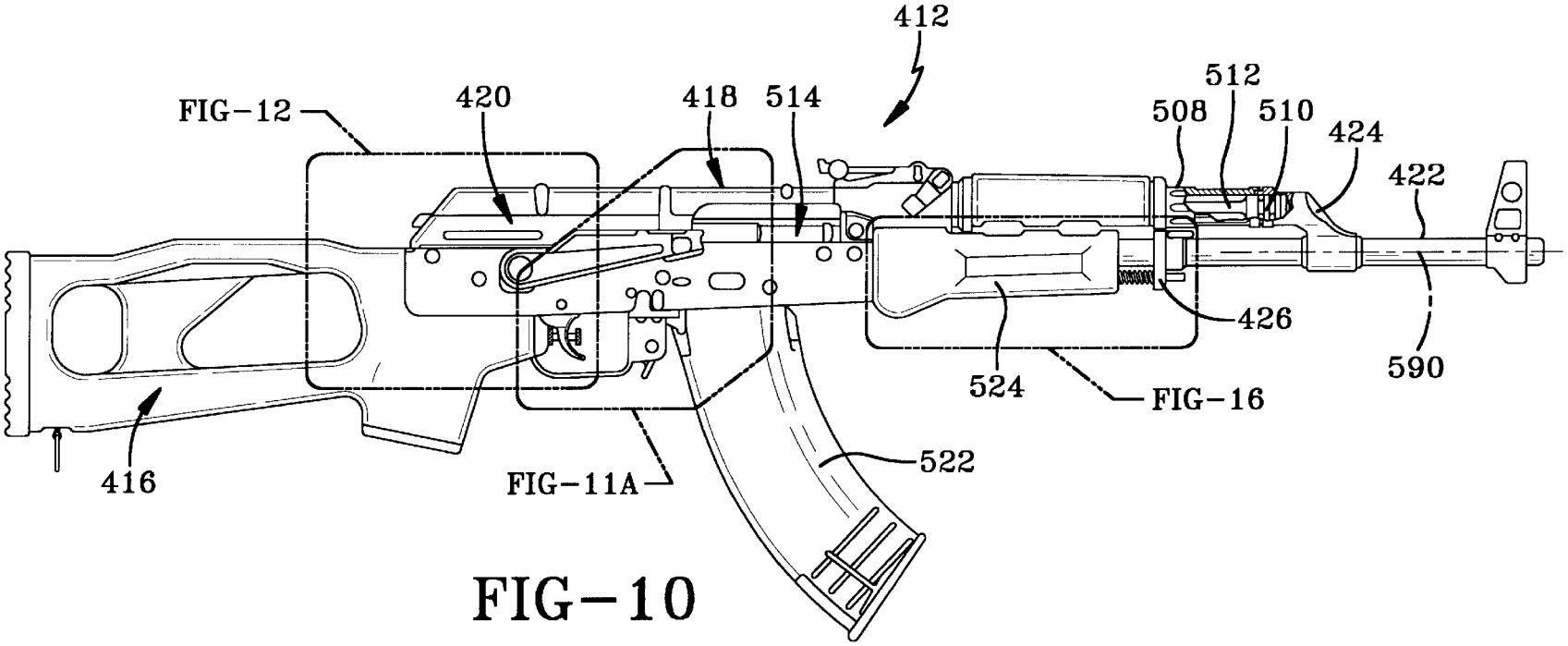
FIG. 10 is a side elevation of a semi-automatic MAK-90 rifle, the stock thereof having been modified to permit selective acceleration of the firing cycle of the MAK-90 without altering the semi-automatic status of that firearm.

Like the SKS Carbine 12, the MAK-90 also contains many safeguards to preclude the firearm from discharging unless the trigger has been reset, as will be hereinafter more fully described. Here too, therefore, in order to provide the most comprehensive understanding as to the operation of an accelerating assembly 410 (FIG. 12) that is particularly adapted for the MAK-90—designated generally by the numeral 412 in FIG. 10—it is appropriate to understand the operation of an MAK-90, and particularly the trigger assembly 414 (FIGS. 11A–11D) of the MAK-90 with which the accelerating assembly 410 can be operatively associated.

The butt stock 416 of the MAK-90 is secured to the rear of a combined receiver and barrel assembly 418. That is, the combined receiver and barrel assembly 418 has a receiver housing 420 to which the barrel 422 is secured, and a gas plug 424 and a connecting ferrule 426 are tightly secured to the barrel 422. Further description of these and other components of a MAK-90 rifle 412 will be provided, as necessary, to impart a full understanding of the acceleration mechanism 410.

MAK-90 Trigger Assembly

With reference to FIGS. 11A–11D, the trigger assembly 414 is operatively associated with a hammer 428. The hammer 428 has a tubular base 430 the opposed ends 432A and 432B (FIG. 11D) of which extend transversely outwardly from the lower end portion 434 of the body portion 436. The opposite end of the body portion 436 terminates in the head portion 438. Three sides 440, 442 and 444 of the hammer head portion 438 overhang the body portion 436 to define a planar surface 446. That portion of the planar surface 446 which extends transversely of the body portion 436 (along side 442) serves as a disconnector notch 448. The two portions of the planar surface 446 which extend laterally of the body portion 436 (along sides 440 and 444, respectively) serve as the cock notches 450A and 450B.

The hammer 428 is pivotally mounted on a hammer pin 452 which is supported from the side walls 454A and 454B of the receiver housing 420. A combined hammer and trigger spring 456 has helically wound portions 458A and 458B which, respectively, circumscribe the opposed, lower end portions 434A and 434B of the tubular base 430. The helically wound portions 458A and 458B are joined by a spring loop 460 that engages a curved portion 462 on the rear face 464 of the hammer 428 to provide the driving impetus of the hammer as it is released to strike a firing pin 466 in the bolt 468. The other end of each helically wound portion 458A and 458B terminates in reaction transfer arms 470A and 470B, respectively, that extend outwardly from the helically wound portions 458 to terminate in bent ends 472A and 472B, respectively. The bent ends 472 each operatively engage the hereinafter described trigger block 474.

The trigger block 474 has a U-shaped cavity 476 bounded by side plates 478A and 478B which extend upwardly from a web plate 480. The trigger 482 extends downwardly from the web plate 480, and a trigger pin 484 penetrates aligned bores 486A and 486B in their respective side plates 478A and 478B to be mounted in the aligned bores 486A and 486B through the sidewalls 454A and 454B of the receiver housing 420.

Figure 11A:
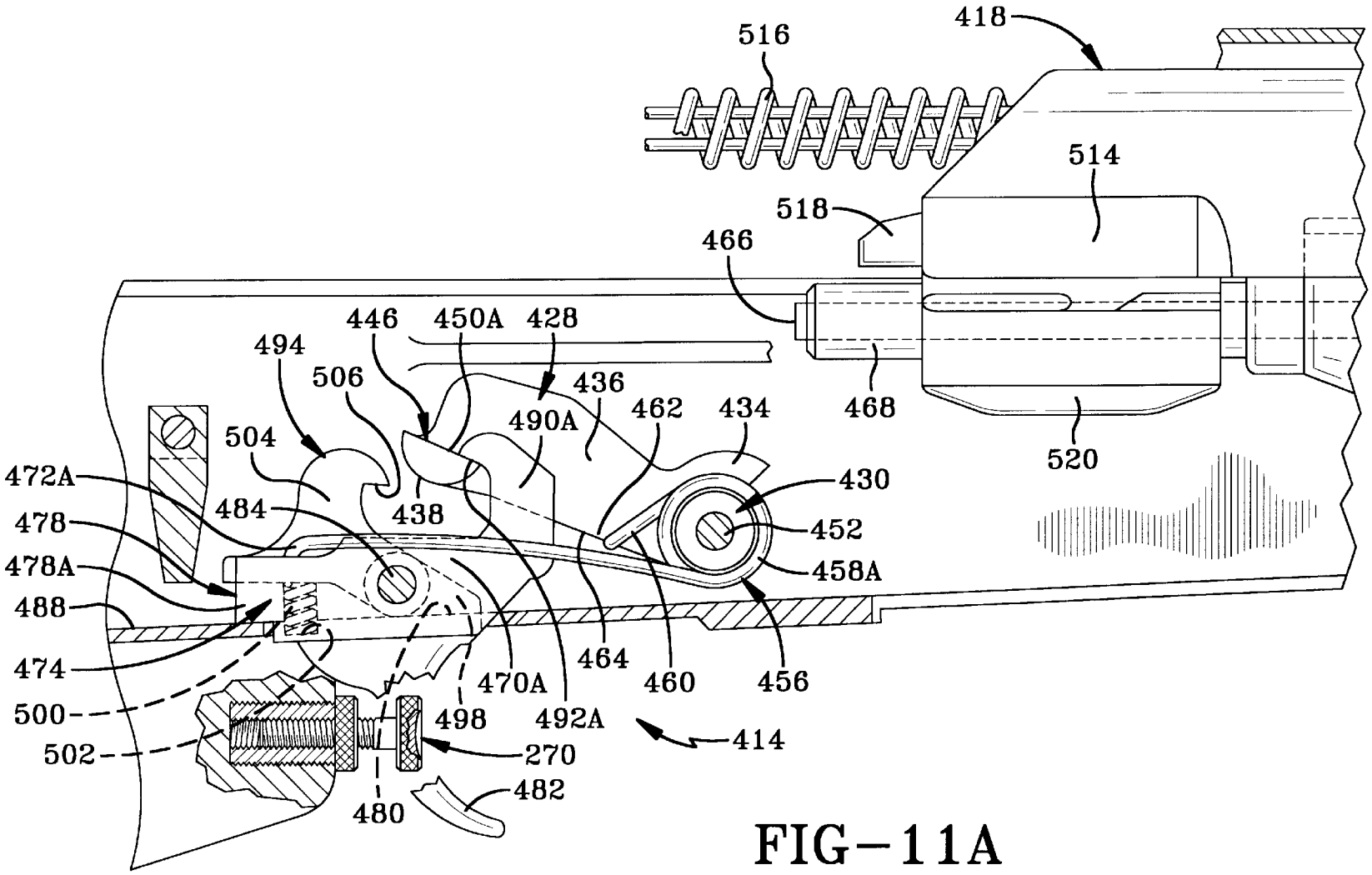
FIG. 11A is an enlarged side elevation partly in section and partly broken away taken within that area of FIG. 10 delineated by the chain line rectangle designated as "FIG. 11A" and depicting the fire control mechanism of a MAK-90 in the ready-to-fire mode of the firing cycle.

It should be understood that the "forward" and "rearward" terminology utilized herein to designate orientation, is based upon the orientation of the firearm itself. As such, the rear portion of each side plate 478A and 478B is engaged by the bent ends 472A and 472B, respectively, of the combined hammer and trigger spring 456. As such, the spring 456 serves to bias the trigger 482 forwardly, about the trigger pin 484. The forward most position of the trigger 482 is controlled by engagement of the side plates 478 with the floor plate 488 of the receiver housing 420, as depicted in FIG. 11A.

Figure 11B:
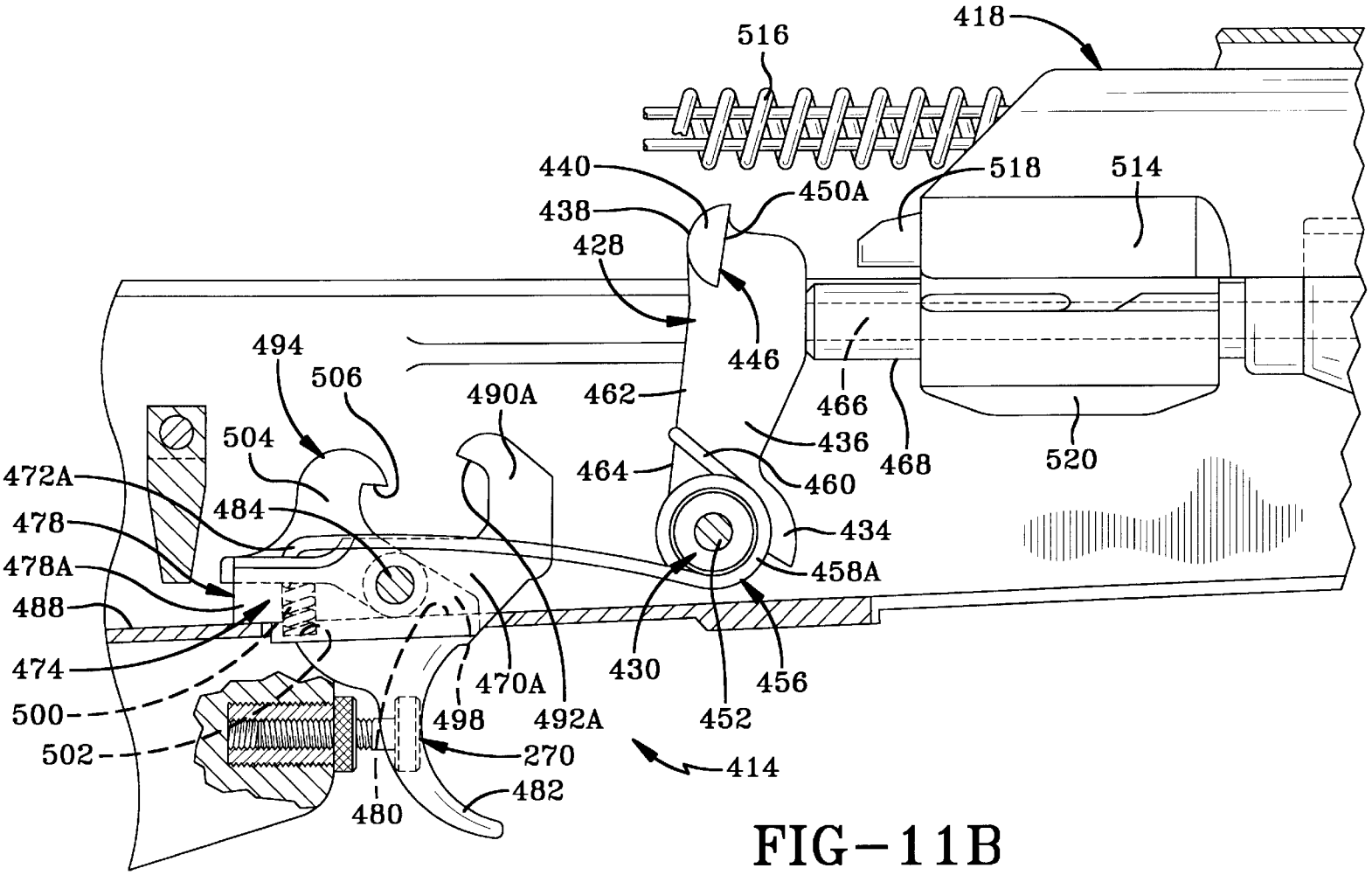
FIG. 11B is a view similar to FIG. 11A with the trigger having been pulled to the firing position.
Figure 11C:
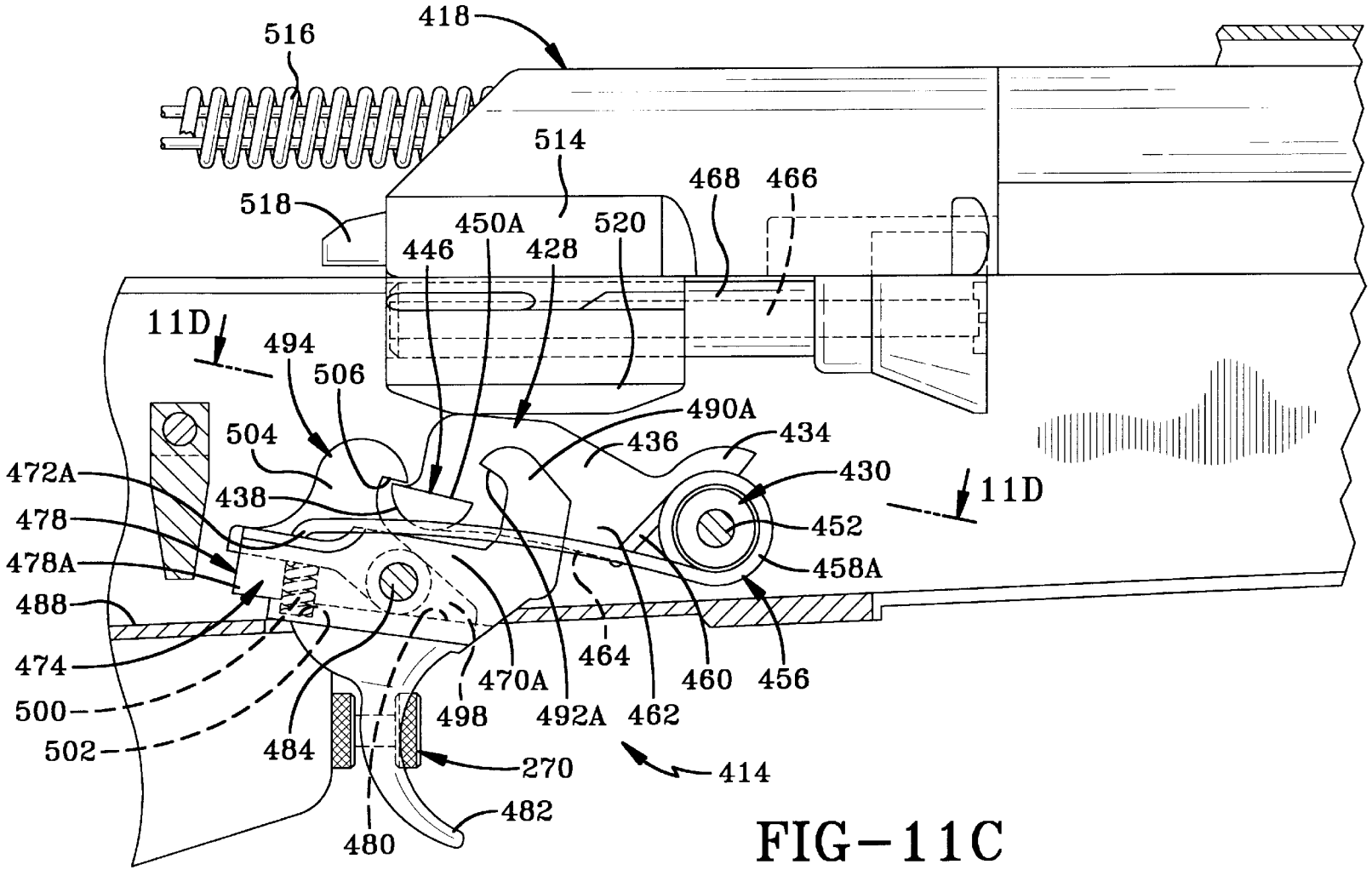
FIG. 11C is a view similar to FIGS. 11A and 11B, but with the fire control mechanism disposed to depict the hammer having been cocked but with the trigger not having been released from the firing position of the firing cycle, as depicted in FIG. 11B and with the bolt in proximity to its rearmost position following discharge of the firearm.
Figure 11D:
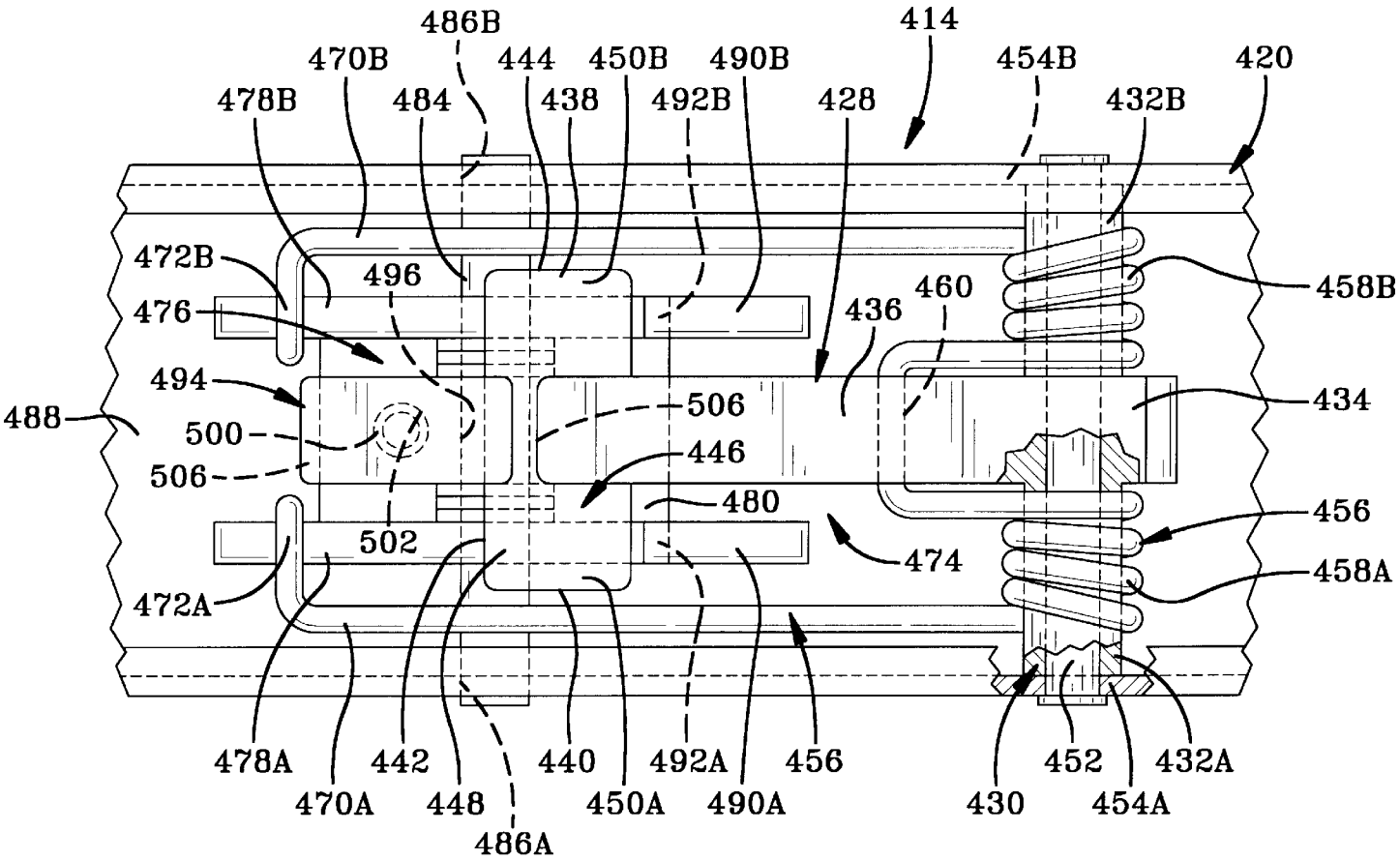
FIG. 11D is an enlarged, transverse section taken substantially along line 11D—11D of FIG. 11C.

As best seen in FIG. 11D, most versions of the MAK-90 utilize a pair of laterally spaced riser claws 490A and 490B that extend upwardly from the forward end of the respective side plates 478A and 478B of the trigger block 474. The upper extremity of each riser claw 490 presents a primary sear 492A and 492B, respectively, which engage the cock notches 450A and 450B on the head portion 438 of the hammer 428. In those versions which utilize only a single riser claw 490 the upper extremity of that riser claw would present a single sear 492, rather than parallel, dual, primary sears 492A and 492B.

A disconnector 494 is received within the cavity 476 between the side plates 478A and 478B of the trigger block 474. The disconnector 494 is provided with a transverse bore 496 to receive the trigger pin 484 on which the disconnector 494 is also pivotally mounted. A stop lug 498 extends forwardly with respect to the transverse bore 496, and the stop lug 498 engages the web plate 480 of the trigger block 474 to limit rotation of the disconnector 494 with respect to the trigger block 474. On the opposite side of the transverse bore 496—relative to the stop lug 498—a disconnector spring 500 is received within an upwardly extending blind bore 502 in the disconnector 494. An upwardly extending arm 504 may be generally aligned with the disconnector spring 500, and the arm 504 terminates in a hooked projection which serves as the auxiliary, or secondary, sear 506.

Operation of the MAK-90 Trigger Assembly

When a cartridge is fired in a standard MAK-90—it will be assumed that the trigger 482 remains depressed in the firing position, as depicted in FIG. 11B—the expanding gases which force the bullet down the barrel 422 enter a gas cylinder 508 (FIG. 10) through gas plug 424 and force a piston 510 and connected operating rod 512 to move the conjoined bolt carrier 514 (FIGS. 11A–11C) rearwardly. Movement of the operating rod 512 and the conjoined bolt carrier 514 to the rear rotates the bolt 468 to unlock its "in battery" position at the breach (not shown) of the barrel 422. Once rotated to its unlocked position the bolt 468 and operating rod 512 move rearwardly together, which compresses the return spring 516. A rearwardly projecting cocking lug 518 on the bolt carrier 514 initially engages the head portion 438 of the hammer 428 such that rearward movement of the carrier 514 rotates the hammer 428 rearwardly about the hammer pin 452 to tense the combined hammer and trigger spring 456. Continued rearward movement of the carrier 514 brings a longitudinal rib 520 on the underside of the bolt 468 into contact with the head portion 438 of the hammer 428 to rotate the head portion 438 past the primary sears 492 and into position such that the biasing action of the disconnector spring 500 will bring the secondary sear 506 into engagement with the disconnector notch 448 on the head portion 438 of the hammer 428. The return spring 516 then moves the bolt 468 (within the carrier 514) and operating rod 512 forwardly to strip a live cartridge from the magazine 522 and force the cartridge into the chamber of the barrel 422, with the bolt 468, carrier 514 and operating rod 512 moving to their fully forward position in readiness to fire the now loaded cartridge. But even with the trigger 482 remaining fully depressed (as represented in FIG. 11B), the hammer 428 remains fully cocked by virtue of the engagement between the secondary sear 506 and the disconnector notch 448.

When the trigger 482 is released, the combined hammer and trigger spring 456 rotates the trigger block 474 clockwise as viewed in FIGS. 11A–11D to swing the primary sears 492A and 492B into position to be engaged by the respective cock notches 450A and 450B as the secondary sear 506 releases the disconnector notch 448 (FIG. 11A).

When the trigger 482 is again depressed (FIG. 11B), the primary sears 492A and 492B simultaneously release the respective cock notches 450A and 450B. The combined hammer and trigger spring 456 then rotates the hammer 428 forwardly to strike the firing pin 466 and thus recycle the firing sequence.

It should be noted that should either the bolt 468 or the operating rod 512 not be fully in the desired forward position for firing, the rearwardly extending cocking lug 518 on the rear of the bolt carrier 514 will be engaged by the falling hammer 428 to prevent the hammer 428 from engaging the firing pin 466.

Modification of a MAK-90 Stock to incorporate an Accelerating Assembly

As was described with respect to the 28 stock modifications necessary to employ an accelerating assembly 10 with the SKS Carbine 12, the MAK-90 stock must also be modified to permit relative longitudinal reciprocation—while maintaining relative lateral and vertical stability—between the combined receiver and barrel assembly 418 and the butt stock 416. Before proceeding, it should be noted that unlike the SKS Carbine, the MAK-90 has a forestock 524 that is separate from the butt stock 416.

Figure 12:
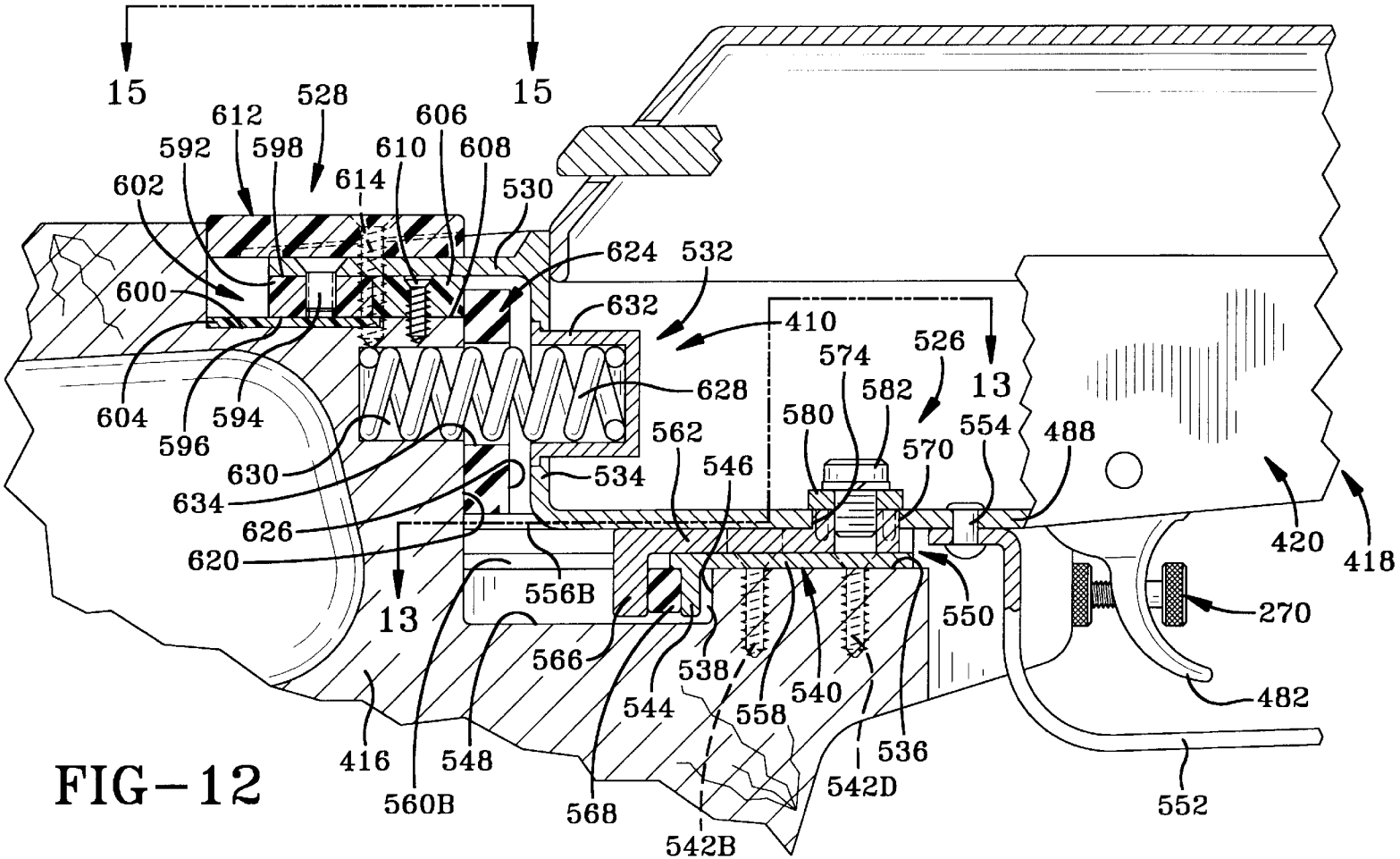
FIG. 12 is an enlarged, longitudinal section taken substantially within that area of FIG. 10 delineated by the chain line rectangle designated as "FIG. 12" and depicting the modified structure by which the receiver and barrel assembly of a MAK-90 is operatively secured to the stock.
Figure 13:
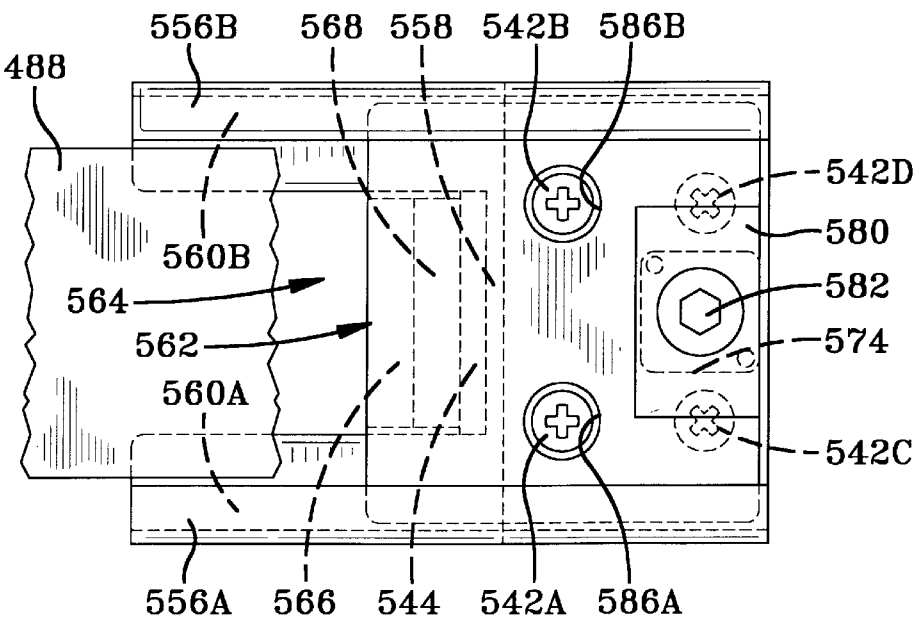
FIG. 13 is an enlarged longitudinal section taken substantially along line 13—13 of FIG. 12 depicting, in top plan, the receiver/stock stabilizing assembly by which the body of the receiver housing in the receiver and barrel assembly is slidingly secured to the stock.
Figures 14, 14A:
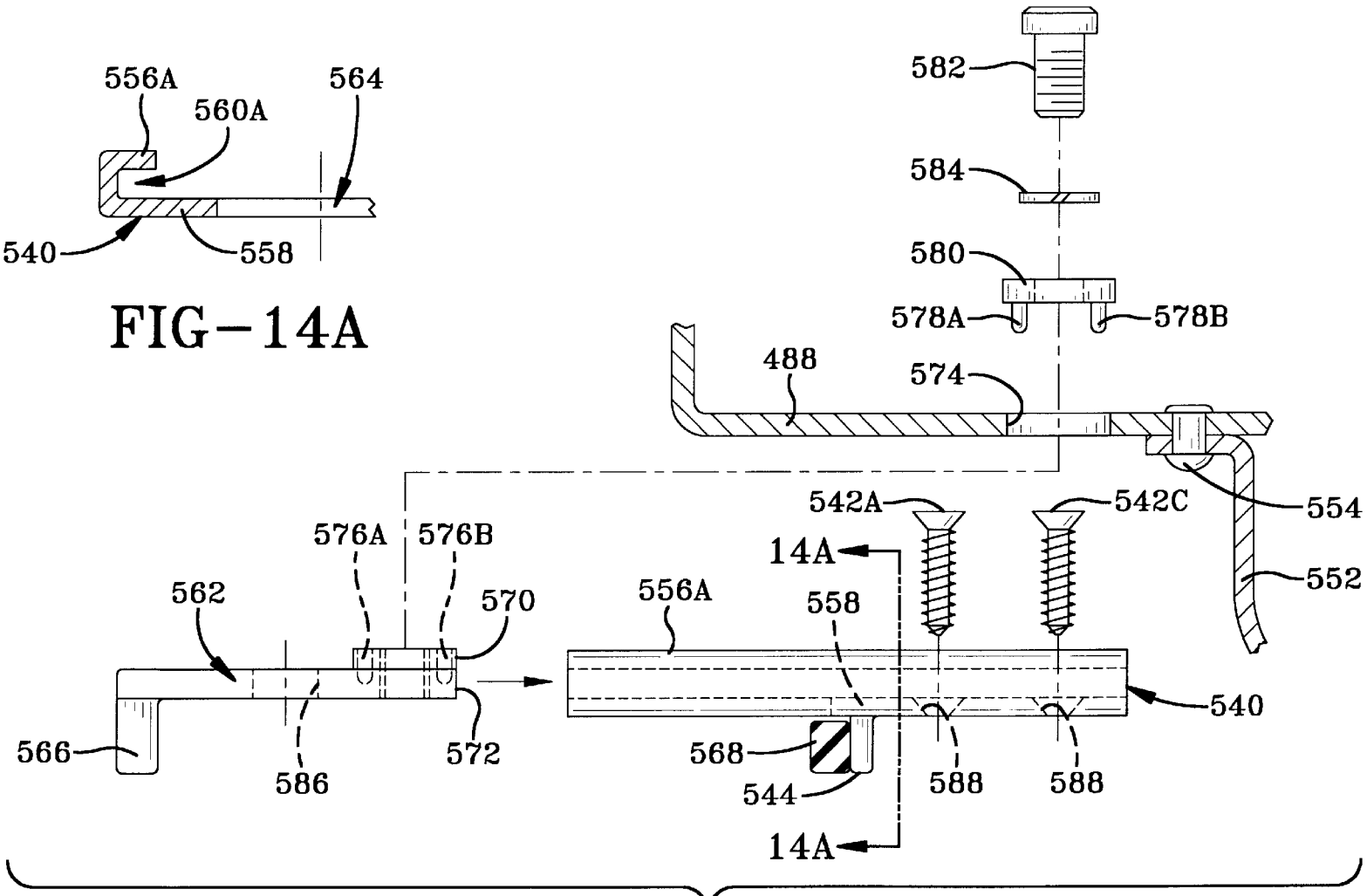
FIG. 14 is an enlarged, exploded, side elevation of the receiver/stock stabilizing assembly depicted in FIG. 13.
FIG. 14A is a transverse section taken substantially along line 14A—14A of FIG. 14.

Continuing with the description of the accelerating assembly 410, and with particular reference to FIGS. 12–14, it can be seen that there is a receiver/stock stabilizing assembly 526 which connects the floor plate 488 of the receiver housing 420 to the butt stock 416 and a tang stabilizing assembly 528 that connects the tang 530 of the receiver housing 420 to the butt stock 416. These two stabilizing assemblies 526 and 528 each accommodate relative longitudinal reciprocation of the combined receiver and barrel assembly 418 with respect to the butt stock 416 but do not permit relative lateral or vertical movement between the combined receiver and barrel assembly 418 and the butt stock 416. There is also a recoil absorber and return assembly 532 which continuously biases the combined receiver and barrel assembly 418 forwardly with respect to the butt stock 416.

Before the details of the embodiment depicted in FIGS. 12–14 are disclosed it must be understood that there is no common configuration for the rear portion of the receiver housing in a MAK-90 rifle 412. Some receiver housings use both an upper and a lower tang. Some use only an upper tang, modifications of which extend, in some modifications, horizontally rearwardly and in other modifications the tangs are inclined downwardly as well as rearwardly. Some receiver housings employ an inclined pistol grip base to receive an elongated mounting screw that extends generally upwardly for the full vertical length of the pistol grip, and some receiver housings use a thin wall mounting plate that extends downwardly and rearwardly from the base of the receiver housing and onto which the pistol grip may be independently secured. Some receiver housings have a base plate that extends along the under side receiver housing and some versions have a base plate that extends horizontally between the lateral side walls of the receiver approximate midway between the top and bottom of the receiver housing.

With that understanding, it must be understood that the description which follows, while detailed as to a receiver housing having a floor plate 488 at the lower extremity as well as a rear plate 534, the concepts described may need to be adapted to the various modifications which exist for the receiver housing of an MAK-90, and particularly regarding the rear portion thereof.

Referring, then, to the receiver/stock stabilizing assembly 526 depicted in FIGS. 12–14, the horizontal shelf 536 of the butt stock 416 on which the floor plate 488 of the receiver housing 420 is supported, must be provided with a stepped recess, as at 538, to accommodate the vertical height of the receiver/stock stabilizing assembly 526 which is installed between the floor plate 488 and the horizontal shelf 536. A mounting base plate 540 is secured, as by flat head screws 542 to the horizontal shelf 536 forwardly of the stepped recess 538. A stop flange 544 extends downwardly from the mounting base plate 540 in proximity to the riser 546 between the horizontal shelf 536 and the lower surface 548 of the stepped recess 538.

In order for the accelerating assembly 410 to operate with a typical MAK-90 rifle 412, the relative longitudinal reciprocation required of the trigger assembly 414 (and the combined receiver and barrel assembly 418 to which the trigger assembly is secured) need be no more than about one-quarter (¼) of an inch. That is, the trigger assembly 414 must reciprocated rearwardly away from the shooter's trigger finger no more than about one-quarter (¼) of an inch. Hence, the butt stock 416 must be recessed, as at 550, at least one-quarter (¼) of an inch to permit the trigger guard 552 (and the head of the rivet 554 by which the rear of the trigger guard 552 is attached to the floor plate 488 of the receiver housing 420) to provide the necessary clearance to accommodate the required rearward reciprocation of the combined receiver and barrel assembly 418 during operation of the accelerating assembly 410.

The lateral edge portions 556A and 556B of the mounting base plate 540 overlie the central portion 558 of the mounting base plate 540 in vertically spaced relation in order to form longitudinally extending rails 560A and 560B within which a slide plate 562 is captured for limited longitudinal reciprocation. The central portion 558 of the mounting base plate 540 is bifurcated, as at 564, to permit a stop flange 566 at the rear of slide plate 562 to extend downwardly at a modestly spaced distance rearwardly of the corresponding stop flange 544 on the mounting base plate 540. Both stop flanges 544 and 566 are located rearwardly of the riser 546 which delineates the stepped recess 538 in the butt stock 416, and a resilient, shock absorbing return bumper 568 is interposed between the stop flanges 544 and 566.

A locating pedestal 570 extends upwardly from the slide plate 562 in proximity to the forward edge 572 of the slide plate 562 to be received within the generally square aperture 574 which is provided in virtually all MAK-90 rifles 412 having a floor plate 488 in the receiver housing 420. The square aperture 574 was provided in order to provide access for the pistol grip mounting screw to engage an anchor plate that was located interiorly of the receiver housing 420 above and slightly forwardly with respect to the location of the square aperture 574. The locating pedestal 570 thus extends upwardly with respect to the lateral edge portions 556 of the mounting base plate 540 and is preferably provided with a pair of recesses 576A and 576B to receive a matching pair of dogs 578A and 578B on a retaining plate 580. As shown, the retaining plate 580 may be secured to the locating pedestal 570 by a machine screw 582 and a lock washer 584. The retaining plate 580 secures the floor plate 488 of the receiver housing 420 in contiguous juxtaposition to the slide plate 562. As such, the floor plate 488 is disposed to lie between the lateral edge portions 556 of the mounting plate 540.

As should be apparent, the slide plate 562 must be received within the rails 560 before the mounting base plate 540 is secured to the horizontal shelf 536 of the butt stock 416. To permit access to the mounting screws 542 at least two access bores 586A and 586B are provided in the slide plate 562. As such, the access bores 586 may be selectively positioned over the rearmost mounting bores 588 in the mounting base plate 540 to permit the flat head screws 542A and 542B to be operatively positioned through the two mounting bores 588 in the mounting plate 540 and into the horizontal shelf 536 on the butt stock 416. By moving the slide plate 562 rearwardly such that the forward edge 572 thereof clears the forward two mounting bores 588, the flat head screws 542C and 542D may be operatively secured through the forward two bores 588 and into the horizontal shelf 536 on the butt stock 416. Thereafter, the locating pedestal 570 may be inserted within the aperture 574 in the floor plate 488 of the receiver housing 420 as the combined receiver and barrel assembly 418 is attached to the butt stock 416.

Figure 15A:
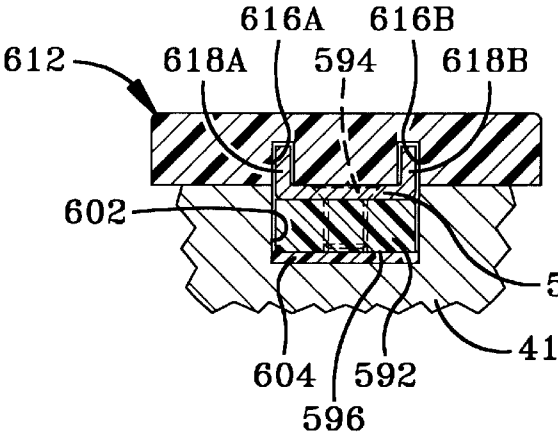
FIG. 15A is a transverse section taken substantially along line 15A—15A of FIG. 15; and, FIG. 16 is an enlarged longitudinal section taken substantially within that area of FIG. 10 delineated by the chain line rectangle designated as "FIG. 16" and depicting the sliding assembly by which the fore-end of the stock may be slidingly secured to the combined receiver and barrel assembly of an MAK-90.
Figure 15:
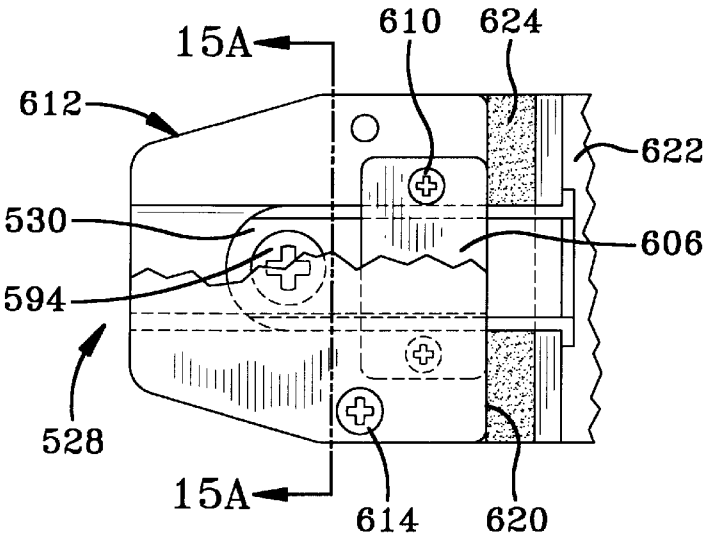
FIG. 15 is a top plan view taken substantially along line 15—15 of FIG. 12 depicting the tang stabilizing assembly by which the tang of the combined receiver and barrel assembly is slidingly attached to the stock—FIG. 15 appearing on the same sheet of drawings as FIG. 13.

With reference to FIGS. 12, 15 and 15A it may be observed that the tang stabilizing assembly 528 similarly accommodates relative reciprocation between the tang 530 and the butt stock 416 while maintaining lateral and vertical stabilization between the tang 530 and the butt stock 416.

On many MAK-90 rifles 412 the tang 530 is disposed to extend rearwardly and downwardly with respect to the axis 590 of the barrel 422. In order to accommodate the specific disposition of the tang 530, the tang stabilizing assembly 528 preferably employs a bearing shim plate 592 that may be secured to the underside of the tang 530, as by the screw 594 depicted. The shim plate 592, like the previously described bearing plates employed with the accelerating assembly 10 employed with the SKS carbine 12, should be made of a material having a low coefficient of friction. Here, too, therefore, the shim plate 592 may, for example, be made of Teflon. As previously indicated, however, Teflon is identified merely by way of example; any suitable bearing material may be substituted for Teflon without departing from the scope of the invention.

In any event, the bearing shim plate 592 may be trapezoidal in vertically longitudinal cross section with the lower surface 596 disposed in a plane that lies parallel with the axis 590 of the barrel 422, and with the upper surface 598 disposed at the same angular disposition as the tang 530 to which it is secured.

The lower surface 596 slidingly engages the base 600 of the longitudinally disposed tang-receiving notch 602. Because of the relative short distance through which the combined receiver and barrel assembly 418 must reciprocate to reset the trigger assembly 414, the base 600 may well be the material from which the butt stock 416 is made. However, one may prefer to secure a fixed bearing plate 604, as shown, to the base 600 in order to minimize wear induced by reciprocation of the shim plate 592.

The foregoing structure may be all that is desired, or required, to effect the stabilization required of the tang 530 inasmuch as the receiver/stock stabilizing assembly 526 is generally sufficient to assure the required joinder of the combined receiver and barrel assembly 418 to the butt stock 416. However, one may include an additional bearing plate 606 which may be secured within a transversely extending dado 608 to provide an additional surface upon which the tang 530 may reciprocate. The additional bearing plate 606 may be secured within the dado 608 by a pair of flat head screws 610.

Finally, one may also incorporate a cover plate 612 to capture the tang 530 and thereby provide a still further means by which to preclude any undesired disengagement of the tang 530 relative to the butt stock 416. The cover plate 612 may also be secured to the butt stock 416 by a pair of wood screws 614. It should be appreciated that the tang 530 is not always a flat piece of metal. As best seen in FIG. 15A the tang 530 may have a generally U-shaped transverse cross section, in which case the underside of the cover plate 612 should be provided with longitudinal recesses 616A and 616B in order to receive the lateral wings 618A and 618B of the tang 530. The recesses 616 are configured to receive the wings 618, but the recesses 616 need not engage the wings 618.

Turning now to the combined recoil absorber and return assembly 526, as is best represented in FIG. 12, the butt stock 416 must be relieved, as defined by the forward facing surface 620. The distance between the forward facing surface 620 and the rear wall 534 of the receiver housing 420 must be sufficient not only to accommodate a recoil bumper 624 but also be sufficient to accommodate as much as about one-quarter (¼) of an inch relative movement between the forwardly facing surface 626 of the recoil bumper 624 mounted on the forwardly facing surface 620 of the butt stock 416 and the rear wall 534 of the receiver housing 422. Here, too, rubber and polyvinyl chloride (PVC) are two materials that can be formulated to provide elasticity to withstand the range of the shock recoil imposed by firing the MAK-90 rifle 412. That is, the recoil bumper 624 must deform to provide the desired translation of the trigger 482 in order to reset the firing mechanism without suffering permanent deformation that would inhibit absorbing the recoil shock induced by successive discharges of the firearm.

The return aspect of the combined recoil absorber and return assembly 532 employs a compression spring 628 that is anchored in a recess 630 provided in the forward facing surface 620 of the butt stop 416, and the opposite end of the compression spring 628 may be received within a cup 632 that is secured to the rear wall 534 of the receiver housing 420. The recess 630 and the interior of the cup 632 are aligned with an aperture 634 that penetrates the recoil bumper 624 to accommodate the compression spring 628.

The accelerating assembly 410 for the MAK-90 also employs a stop means 270 that may be of identical configuration to the stop means described in detail with respect to the SKS carbine 12. Moreover, the operation of the stop means 270 used with the MAK-90 rifle 412 is identical to the operation of the stop means used with the SKS carbine 12 and does not, therefore, need to be repeated.

Optional Forestock Modification for an MAK-90

A MAK-90 stock that has not been modified to accept the accelerating assembly 410 has the forward portion of the forestock 524 anchored to the connecting ferrule 426 and the rearward portion of the forestock 524 anchored to the forward portion of the receiver housing 420. That is, an extension on the rear portion of the forestock 524 is inserted into the forward end of the receiver housing 420, and a companion extension on the forward portion of the forestock 524 is received within the rearwardly facing recess 636 of the connecting ferrule 426.

The accelerating assembly 410 will operate quite satisfactorily without any change being made to the forestock 524. However, without any change to the forestock 524 it will move with the combined receiver and barrel assembly 418, and that can be disconcerting—particularly if one would wish to mount a bipod to the forestock 524.

Figure 16:
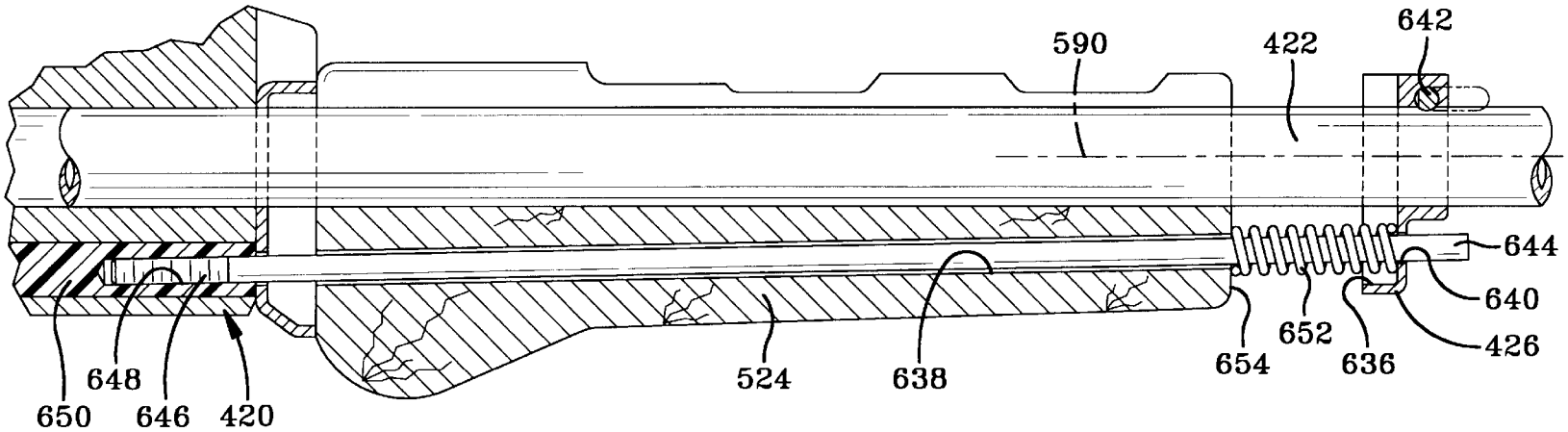

Thus, if one wishes fully to accommodate the forestock 524 to the operation of the accelerating assembly 410, the extensions on both the rear and the forward portions of the forestock 524 are preferably removed to allow the forestock 524 to reciprocate longitudinally with respect to the barrel 422. With reference to FIG. 16, it can be observed that the forestock 524 has a generally longitudinally oriented storing cavity in the configuration of a bore 638 that is aligned with a circular aperture 640 which penetrates the connecting ferrule 426.

A release pin 642 allows the connecting ferrule 426 to be selectively locked at a predetermined position along the length of the barrel 422. The release pin 642 may be rotated approximately one hundred and eighty degrees (180°) selectively to engage or disengage the connecting ferrule 426 from the barrel 422.

In modifying the stock of a MAK-90 rifle 412 to accept the accelerating assembly 410, the forestock 524 is shortened to terminate in spaced relation rearwardly of the connecting ferrule 426, and a guide rod 644 is received within the storing notch 638 that was provided for the cleaning rod (not shown). The rear terminus of the guide rod 644 is preferably threaded, as at 646, to be secured within a threaded bore 648 in an anchor block 650 that may be frictionally secured within the hollow forward portion of the receiver housing 420. The anchor block 650 may also be made of Teflon, or the like. The forward end portion of the guide rod 644 extends longitudinally from the storing cavity 638 in the forestock 524 through the aperture 640 in the connecting ferrule 426, and a compression spring 652 circumscribes the guide rod 644 to be interposed between the face 654 of the forestock 524 and the connecting ferrule 426. To minimize wear to the face 654 by action of the compression spring 652—which may most likely be encountered with wood forestocks—a washer (not shown) may be interposed between the face 654 and the adjacent end of the compression spring 652. However, wear to the face 654 is not generally encountered, even with wood forestocks 524.

Typically, the storing cavity 638 is not truly parallel with the axis 590 barrel 422, but is rather canted slightly downwardly—approximately two degrees (2°)—from the front to the rear. As such, the modified forestock 524 of a MAK-90 has some moderate stability with respect to the barrel 422, particularly if the diameter of the guide rod 644 is substantially equal to the diameter of the cavity bore 638. On the other hand, the slight inclination of the guide rod 644 with respect to the cavity bore 638 does not restrict the longitudinal reciprocation of the forestock 524 with respect to the barrel 422 in as much as only approximately one-quarter (¼) of an inch of relative travel between the forestock 524 and the barrel 422 is required for the forestock 524 to remain stationary as the accelerating assembly 410 permits the combined receiver and barrel assembly 418 to reciprocate, as previously described.

Conclusion Relative to the MAK-90

The foregoing description of the preferred, and one alternative modification of the present invention as applied to a MAK-90 rifle 412 have been presented for the purposes of illustration and description. The foregoing description is not intended to be exhaustive or to limit the invention to the precise form disclosed. Obvious modifications or variations are possible in light of the above teachings. The embodiments described were chosen and described to provide the best illustration of the principles of the invention and its practical application in order to enable one of ordinary skill in the art to utilize the invention and various embodiments thereof with, or without the various modifications, as are suited to the particular use contemplated. All such variations and modifications are within the scope of the invention as determined by the appended claims when interpreted in accordance with the breadth to which they are fairly and legally entitled.

The essence of this inventive concept lies in the fact that in the construction of the standard MAK-90 rifle 412 the combined receiver and barrel assembly 418 is rigidly attached to the standard butt stock 416, which causes a significant recoil of the entire firearm each time the trigger is pulled. By relieving certain parts of the stock, as heretofore described, the combined receiver and barrel assembly, and the mechanism supported therefrom, recoils no more than approximately one-quarter (¼) an inch within the stock, thereby lessening the actual recoil imparted to the shooter. This factor is an added benefit to the shooter, even though it is not the primary object of this invention.

Conclusion as to the Invention

As should now be apparent, the present invention not only teaches that an accelerating assembly embodying the concepts of the present invention permits enhancement of the cyclic firing rate of a semi-automatic firearm, but also accomplishes the other objects of the invention.

I claim:

1. An accelerating mechanism by which to increase the cyclic rate at which the trigger of a semi-automatic firearm can be actuated to discharge the firearm, the firearm having a supporting device, a receiver and a barrel supported from the supporting device, a trigger mechanism secured to the receiver and presenting a trigger, said accelerating mechanism comprising:

means to permit the receiver, barrel and trigger mechanism to translate rearwardly a finite distance with respect to the supporting device in response to the recoil imparted to at least the trigger mechanism by the discharge of the semi-automatic firearm;

means continuously biasing at least the trigger mechanism to translate forwardly with respect to the supporting device substantially said same predetermined distance;

a locating stop means mounted on the supporting device;

said locating stop means disposed to be engaged by the shooter's finger after the trigger has been actuated to fire the semi-automatic firearm, said engagement of the shooter's trigger finger with said locating stop effectively immobilizing the shooter's trigger finger with respect to said supporting device until the shooter releases his trigger finger from said locating stop means.

2. The accelerating mechanism, as set forth in claim 1, further comprising:

bumper means interposed between the receiver and said supporting device to dissipate shock loading.

3. The accelerating mechanism, as set forth in claim 1, wherein said means longitudinally biasing at least the trigger mechanism comprises:

a coil spring operatively interposed between said supporting device and at least the trigger mechanism.

4. The accelerating mechanism, as set forth in claim 1, further comprising:

a return bumper to absorb any shock imposed by said means continuously biasing at least the trigger mechanism.

5. The accelerating mechanism, as set forth in claim 3, further comprising:

bearing means interposed between at least selected of those components which translate with respect to each other.

6. The accelerating mechanism, as set forth in claim 3, wherein:

a shaft is secured to extend forwardly from said supporting device;

a coil spring circumscribes said supporting device;

a ferrule is secured to the barrel;

said coil spring being interposed between said supporting device and said ferrule.

7. An accelerating mechanism by which to increase the cyclic firing rate of a firearm in combination with a semi-automatic firearm, said combination comprising:

a receiver and barrel assembly;

a trigger assembly including a trigger and fire control mechanism supported from said receiver and barrel assembly;

said trigger having a ready-to-fire position, a fire position and a reset position located between said ready-to-fire position and said fire position;

a supporting device;

said fire control mechanism requires that said trigger move rearwardly a finite distance with respect to said receiver and barrel assembly from said ready-to-fire position to said fire position in order to discharge the firearm as well as to require that said trigger move forwardly a finite distance with respect to said receiver and barrel assembly to said reset position after said firearm has been discharged in order to recycle said firing mechanism to permit a successive discharge of said firearm as the trigger is moved from said reset position to said fire position;

a stop means presented from said supporting device to control the rearward movement of a shooter's trigger finger relative to said supporting device;

said accelerating mechanism permitting said receiver and barrel assembly, together with said trigger and fire control mechanism, to move rearwardly with respect to said supporting device at least that finite distance required to move said trigger from said fire position to said reset position in order to cycle the fire control mechanism and then be biased forwardly with respect to said supporting device at least the distance required to move the trigger from said reset position to said fire position by engagement of said trigger against the shooter's trigger finger.

8. The combination, as set forth in claim 7, wherein:

the forward biasing of the receiver and barrel assembly, together with said trigger and fire control mechanism, is accomplished by a compression spring disposed between said supporting device and said receiver and barrel assembly.

9. The combination, as set forth in claim 7, further comprising:

return bumper means to cushion the movement of said receiver and barrel assembly as well as said trigger and fire control mechanism to their forwardmost position with respect to said supporting device.

10. The combination, as set forth in claim 8, further comprising:

a connecting ferrule supported from the barrel;

a fore-end integral with said supporting device;

said compression spring being disposed between said fore-end and said connecting ferrule.

11. The combination, as set forth in claim 8, further comprising:

bearing means disposed at selected locations between said supporting device and said receiver and barrel assembly.

12. The combination, as set forth in claim 11, wherein said bearing means comprises:

relatively low friction material interposed at selected locations between said receiver and barrel assembly and said supporting device.

13. The combination, as set forth in claim 8, wherein said supporting device comprises:

a butt portion; and, said compression spring is disposed between said butt portion of said supporting device and said receiver and barrel assembly.

14. The combination, as set forth in claim 13, further comprising:

a first stop flange presented from a mounting plate secured to said butt portion;

a second stop flange presented from a slide plate secured to said receiver and barrel assembly;

a return bumper interposed between said first and second stop flanges to absorb any shock imposed by said compression spring between said butt portion and said receiver and barrel assembly.

15. The combination, as set forth in claim 13, further comprising:

an anchor plate secured to said butt portion;

rail means presented from said anchor plate;

a slide plate mounted between said rail means for longitudinal reciprocation;

means connecting said receiver and barrel assembly to said slide plate.

16. The combination, as set forth in claim 15, further comprising:

a forestock separate from said butt portion;

said forestock supported from said receiver and barrel assembly for limited reciprocation.

17. The combination, asset forth in claim 16, further comprising:

spring means to define an at-rest position of said forestock with respect to said receiver and barrel assembly.

18. The combination, as set forth in claim 17, further comprising:

a guide means supported between said receiver housing and a ferrule mounted on said barrel;

said forestock mounted on said guide means for longitudinal reciprocation;

said spring means circumscribing said guide means and extending between said forestock and said ferrule.

19. A method of accelerating the firing cycle of a semi-automatic firearm comprising the steps of:

depressing the trigger with a shooter's trigger finger to discharge the firearm;

immobilizing the shooter's finger in the position it has assumed to discharge the firearm;

translating the trigger away from the immobilized trigger finger to effect a total disengagement therebetween; and, sequentially biasing the trigger into engagement with the immobilized trigger finger to effect successive discharges of the firearm.

* * * * *